US007140083B2

(12) United States Patent
Ito

(10) Patent No.: US 7,140,083 B2
(45) Date of Patent: Nov. 28, 2006

(54) METHOD OF MANUFACTURING AN INK JET PRINTER HEAD INCLUDING A PLURALITY OF CAVITY UNITS

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 407 days.

(21) Appl. No.: 10/721,715

(22) Filed: Nov. 25, 2003

(65) Prior Publication Data

US 2004/0104954 A1 Jun. 3, 2004

(30) Foreign Application Priority Data

Nov. 26, 2002 (JP) ..... 2002-342409

(51) Int. Cl.
*H04R 17/00* (2006.01)

(52) U.S. Cl. ..... 29/25.35; 29/890.1; 29/759; 29/760

(58) Field of Classification Search ..... 29/25.35, 29/890.1, 759, 760; 347/20, 42, 47, 48, 54, 347/49, 70, 71, 13, 15
See application file for complete search history.

(56) References Cited

U.S. PATENT DOCUMENTS 4,611,219 A * 9/1986 Sugitani et al. ..... 347/40
5,402,159 A 3/1995 Suzuki et al.
5,963,234 A * 10/1999 Miyazawa et al. ..... 347/70
6,554,409 B1 * 4/2003 Ishii ..... 347/71
6,648,463 B1 * 11/2003 Koga et al. ..... 347/100
2002/0024568 A1 2/2002 Ito et al.

FOREIGN PATENT DOCUMENTS

JP A 4-341853 11/1992
JP 2002-144590 5/2002

* cited by examiner

*Primary Examiner*—A. Dexter Tugbang
*Assistant Examiner*—Tai Van Nguyen
(74) *Attorney, Agent, or Firm*—Reed Smith LLP

(57) ABSTRACT

A nozzle sheet has arrays of nozzles, and additionally has two first positioning holes on opposite sides of the arrays of nozzles, respectively, that are opposite to each other in a lengthwise direction of the nozzle sheet, and two second positioning holes in respective vicinities of the two first positioning holes. When the nozzle sheet is adhered to a lower surface of a channel unit consisting of a plurality of sheet members and having a plurality of ink channels, first, two first positioning pins of a first jig are fitted in the two first positioning holes of the nozzle sheet so as to position the nozzle sheet relative to the first jig and, subsequently, the channel unit is adhered to the nozzle sheet so as to provide a cavity unit. When a plurality of ejector units each of which includes an actuator fixed to an upper surface of the cavity unit are fixed to a frame member of an ink jet printer head, such that the ejector units extend parallel to each other, first, two pairs of second positioning pins of a second jig are fitted in the respective pairs of second positioning holes of the respective nozzle sheets of the ejector units and then the ejector units are fixed with an adhesive to the frame member.

15 Claims, 16 Drawing Sheets

METHOD OF MANUFACTURING AN INK JET PRINTER HEAD INCLUDING A PLURALITY OF CAVITY UNITS

BACKGROUND OF THE INVENTION

1. Field of the Invention

The present invention relates to an ink jet printer head, such as a piezoelectric-type one, and an ejector unit for use in the printer head and having a nozzle and an actuator to eject a droplet of ink from the nozzle, and particularly to such an ejector unit which has a structure assuring that the ejector unit per se can be accurately assembled and that a plurality of ejector units can be fixed to a frame member of a printer head that has an ink-supply passage to supply ink to the ejector units, while the ejector units can be accurately positioned relative to each other.

2. Discussion of Related Art

An on-demand-type piezoelectric ink jet printer head is disclosed by, e.g., Japanese Patent Application Publication No. 2002-144590A1 or its corresponding U.S. Patent Application Publication No. 2002-0024568A1. The known printer head employs an ejector unit including a cavity unit consisting of a plurality of sheet members stacked on each other. The stacked sheet members include a nozzle sheet having a number of nozzles arranged in at least one array; at least one manifold sheet stacked on the back surface of the nozzle sheet with an adhesive and having at least one ink manifold communicating with an ink supply source; a base sheet having a number of pressure chambers communicating with the nozzles, respectively; and a spacer sheet interposed between the base sheet and the manifold sheet and having first ink channels connecting between the ink manifold and the pressure chambers and second ink channels connecting between the pressure chambers and the nozzles. The ejector unit additionally includes an actuator that is bonded to the back surface of the cavity unit and is operated to apply an energy (e.g., a pressure) to each of the pressure chambers so as to eject a droplet of ink from the each pressure chamber via a corresponding one of the nozzles.

The above-identified document recites that two or more ejector units are fixed, with an adhesive, to respective recesses formed in a lower surface of a frame member formed of a synthetic resin. To this end, the above-indicated nozzle sheet of each of the ejector units has two positioning holes in two opposite end portions thereof, respectively, that are opposite to each other in the direction in which the nozzles are arranged in the array, and two or more pairs of positioning pins of a jig are fitted in the respective pairs of positioning holes of the respective nozzle sheets of the ejector units, so that the ejector units, fixed to the frame member, extend parallel to each other and are distant from each other by a predetermined distance.

Meanwhile, when the nozzle sheet having the nozzles is bonded to a channel unit consisting of stacked sheet members having the pressure chambers and the ink channels, the above-indicated two positioning holes of the nozzle sheet have conventionally been used to accurately position the ink channels and the nozzles relative to each other, That is, the two positioning holes of the nozzle sheet are used twice in two operations, i.e., the first operation to prepare the ejector unit by bonding the channel unit and the nozzle sheet to each other, and the second operation to attach the ejector unit to the frame member. In the first operation, however, when positioning pins of a first jig are fitted in the positioning holes of the nozzle sheet, or are pulled out of the positioning holes, the positioning holes may be deformed and/or the diameter thereof may be increased. In this case, in the second operation in which the positioning holes are used for the second time, positioning pins of a second jig may not be fitted in the positioning holes, or may rattle in the positioning holes. In addition, in the case where two or more ejector units are fixed by adhesion to the frame member, it is difficult to accurately align the direction of extension of each of the nozzles of the ejector units with respect to a reference direction on the frame member. Moreover, the degree of parallelism between the respective nozzle arrays of the ejector units, and/or a distance between the respective nozzle arrays may suffer an increased error, so that ink is recorded, on a recording medium such as a sheet of paper, at a position deviated from a correct position. This means a lowered accuracy of printing of the printer head,

SUMMARY OF THE INVENTION

It is therefore an object of the present invention to provide an ink jet printer head and an ejector unit for use in the printer head, each of which is free of at least one of the above-identified problems. This object may be achieved according to any one of the following modes of the present invention in the form of an ink jet printer head, an ejector unit, and an ink jet printer head manufacturing method.

(1) An ink jet printer head, comprising: a plurality of ejector units each of which includes (a) a cavity unit which has a plurality of nozzles provided in an outer surface thereof and arranged in a reference direction, a plurality of ink chambers which communicate with the plurality of nozzles, respectively, and in each of which an ink is accommodated, and a plurality of ink channels communicating with the plurality of nozzles via the plurality of ink chambers, respectively, and (b) an actuator which applies an energy to the each of the ink chambers so as to eject a droplet of the ink from a corresponding one of the nozzles via a corresponding one of the ink channels; a frame member having at least one ink supply passage through which the ink is supplied from at least one ink supply source to the ejector units, the ejector units being fixed in position to the frame member, the cavity unit of said each of the ejector units including a channel unit having the ink chambers and the ink channels, and a nozzle sheet having the nozzles arranged in the reference direction, the nozzle sheet of said each ejector unit being fixed in position to the channel unit thereof, the nozzle sheet of said each ejector unit having, in two end portions thereof that are opposite to each other in the reference direction, two first positioning holes, respectively, into which two first positioning pins of a first jig are inserted when the nozzle sheet of said each ejector unit is fixed to the channel unit thereof, the nozzle sheet of said each ejector unit additionally having, in said two end portions thereof, two second positioning holes, respectively, into which corresponding two second positioning pins out of a plurality of pairs of second positioning pins of a second jig are inserted when the ejector units are fixed to the frame member, the channel unit of said each ejector unit having two first blind holes in communication with the two first positioning holes, respectively, and two second blind holes in communication with the two second positioning holes, respectively, the two first positioning pins of the first jig being inserted via the two first positioning holes into the two first blind holes, respectively, when the nozzle sheet of said each ejector unit is fixed to the channel unit thereof, the two second positioning pins of the second jig being inserted via the two second positioning holes into the two second blind holes, respectively, in a state in which the nozzle sheet of said each ejector unit is fixed to the channel unit thereof. In the case where the present printer head employs a single sort of ink, for example, a black ink, the frame member may have a single ink supply passage through which the black ink may be supplied from a single ink supply source to each of the ejector units. On the other hand, in the case where the present printer head employs a plurality of sorts of ink, for example, a black ink and a red ink, the frame member may have a plurality of ink supply passages through which the black and red inks may be supplied from two ink supply sources to two ejector units, respectively.

Since the nozzle sheet of each ejector unit has the two pairs of positioning holes, one pair of positioning holes are used when the nozzle sheet and the channel unit are fixed to each other to prepare the each ejector unit and the other pair of positioning holes are used when the each ejector unit and the frame member are fixed to each other. That is, the two pairs of positioning holes are used in the two different operations, respectively. According to the present invention, even if a pair of positioning holes are used such that positioning pins are fitted therein and are pulled therefrom and consequently the positioning holes are deformed or the diameter of the same is increased, i.e., the accuracy of positioning of the same is lowered, the positioning holes are not used again. Therefore, in each of the two different operations, a corresponding pair of positioning holes are used with a high positioning accuracy and without any possibilities that positioning pins cannot be fitted therein. In addition, since the channel unit of each ejector unit has the first and second blind holes respectively communicating with the first and second positioning holes, the first or second positioning pins are prevented from interfering with the channel unit, even if an axial length of each of the positioning pins is somewhat longer than that of a corresponding one of the positioning holes. Moreover, since the blind holes are not through-holes, the ink can be prevented from leaking to outside through the positioning holes. However, the blind holes may be replaced with through-holes that are formed through the thickness of a portion of the channel unit that has no ink chambers nor ink channels.

(2) The ink jet printer head according to the mode (1), wherein the frame member has a bottom wall including a plurality of support portions which support respective back surfaces of the plurality of ejector units such that a plurality of portions of the back surface of the each ejector unit are exposed in a plurality of through-holes of the bottom wall, respectively, and wherein the through-holes of the bottom wall are filled with an adhesive so as to fix the each ejector unit to the frame member. The adhesive may be a quickly curing adhesive such as an ultraviolet-light curing adhesive.

According to this mode, each of the ejector units can be quickly fixed to the frame member, with the adhesive filling the spaces left between the back surface of the each ejector unit and the wall surfaces defining the through-holes. In addition, the each ejector unit can be positioned relative to the frame member with minimized errors.

(3) The ink jet printer head according to the mode (1) or (2), wherein each of the respective nozzle sheets of the plurality of ejector units has the plurality of nozzles arranged in at least one array in the reference direction, and the plurality of ejector units are fixed to the frame member such that the respective arrays of nozzles of the plurality of ejector units are parallel to each other and are distant from each other by a predetermined distance.

When the plurality of ejector units are fixed to the single frame member such that the ejector units extend parallel to each other, the second positioning holes that are different from the first positioning holes and have not been used yet are used to define a high degree of parallelism between the respective nozzle sheets of the ejector units, more specifically described, between the respective nozzle arrays of the nozzle sheets, and an accurate distance between the respective nozzle arrays. This leads to a high accuracy of printing of the printer head. In addition, the efficiency with which the ejector units are attached to the frame member is much improved.

(4) An ejector unit for use in an ink jet printer head including a frame member having at least one ink supply passage through which an ink is supplied from at least one ink supply source to the ejector unit, the ejector unit being fixed to the frame member, the ejector unit comprising: a cavity unit which has a plurality of nozzles provided in an outer surface thereof and arranged in a reference direction, a plurality of ink chambers which communicate with the plurality of nozzles, respectively, and in each of which the ink is accommodated, and a plurality of ink channels communicating with the plurality of nozzles via the plurality of ink chambers, respectively; and an actuator which applies an energy to the each of the ink chambers so as to eject a droplet of the ink from a corresponding one of the nozzles via a corresponding one of the ink channels, the cavity unit including a channel unit having the ink chambers and the ink channels, and a nozzle sheet having the nozzles arranged in the reference direction, the nozzle sheet being fixed in position to the channel unit, the nozzle sheet having, in two end portions thereof that are opposite to each other in the reference direction, two first positioning holes, respectively, into which two first positioning pins of a first jig are inserted when the nozzle sheet is fixed to the channel unit, the nozzle sheet additionally having, in said two end portions thereof, two second positioning holes, respectively, into which corresponding two second positioning pins out of a plurality of pairs of second positioning pins of a second jig are inserted when a plurality of ejector units including the ejector unit are fixed to the frame member, the channel unit having two first blind holes in communication with the two first positioning holes, respectively, and two second blind holes in communication with the two second positioning holes, respectively, the two first positioning pins of the first jig being inserted via the two first positioning holes into the two first blind holes, respectively, when the nozzle sheet is fixed to the channel unit, the two second positioning pins of the second jig being inserted via the two second positioning holes into the two second blind holes, respectively, in a state in which the nozzle sheet is fixed to the channel unit.

(5) The ejector unit according to the mode (4), wherein the channel unit includes a base sheet having the ink chambers, and a plurality of channel sheets which cooperate with each other to define the ink channels and the first and second blind holes, the base sheet and the channel sheets being stacked on each other to provide a stacked body, and wherein the nozzle sheet having the nozzles is fixed to the stacked body by inserting the two first positioning pins via the two first positioning holes of the nozzle sheet, respectively, into the two first blind holes of the stacked body, respectively.

Since the channel unit is prepared, in advance, as the stacked body consisting of the base sheet having the ink chambers, and the plurality of channel sheets defining the ink channels, the nozzle sheet to be fixed to the channel unit may be one having a shape different from that of the channel unit.

(6) An ink jet printer head, comprising a plurality of ejector units each of which has a plurality of nozzles, a plurality of ink chambers which communicate with the plurality of nozzles, respectively, and in each of which an ink is accommodated, a plurality of ink channels communicating with the plurality of nozzles via the plurality of ink chambers, respectively, and an actuator which applies an energy to the each of the ink chambers so as to eject a droplet of the ink from a corresponding one of the nozzles via a corresponding one of the ink channels; the cavity unit of the each of the ejector units including a channel unit having the ink chambers and the ink channels, and a nozzle sheet having the nozzles, the channel unit and the nozzle sheet of the each ejector unit being fixed to each other; and the nozzle sheet of the each ejector unit having two first positioning holes, and two second positioning holes.

(7) A method of manufacturing an ink jet printer head including (a) a plurality of cavity units each of which has a plurality of nozzles, a plurality of ink chambers which communicate with the plurality of nozzles, respectively, and in each of which an ink is accommodated, and a plurality of ink channels communicating with the plurality of nozzles via the plurality of ink chambers, respectively, and (b) a plurality of actuators each of which applies an energy to each of the ink chambers of a corresponding one of the cavity units so as to eject a droplet of the ink from a corresponding one of the nozzles via a corresponding one of the ink channels, the method comprising the steps of preparing a plurality of nozzle sheets each of which has the plurality of nozzles, two first positioning holes, and two second positioning holes, preparing a plurality of channel units each of which has the plurality of ink chambers to accommodate the ink and communicate with the plurality of nozzles, respectively, of a corresponding one of the nozzle sheets, and the plurality of ink channels to communicate with the plurality of nozzles of the corresponding nozzle sheet via the plurality of ink chambers, respectively, causing two first positioning pins of a first jig to fit in the two first positioning holes of the each of the nozzle sheets so as to position the each nozzle sheet relative to the first jig, fixing the each nozzle sheet positioned relative to the first jig, and a corresponding one of the channel units, to each other, so as to provide a corresponding one of the cavity units, causing a first pair of second positioning pins of a second jig to fit in the two second positioning holes of the nozzle sheet of a first one of the cavity units, and causing a second pair of second positioning pins of the second jig to fit in the two second positioning holes of the nozzle sheet of a second one of the cavity units, so that the first and second cavity units are positioned relative to the second jig and are thereby positioned relative to each other, and fixing the first and second cavity units positioned relative to each other, to a frame member.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
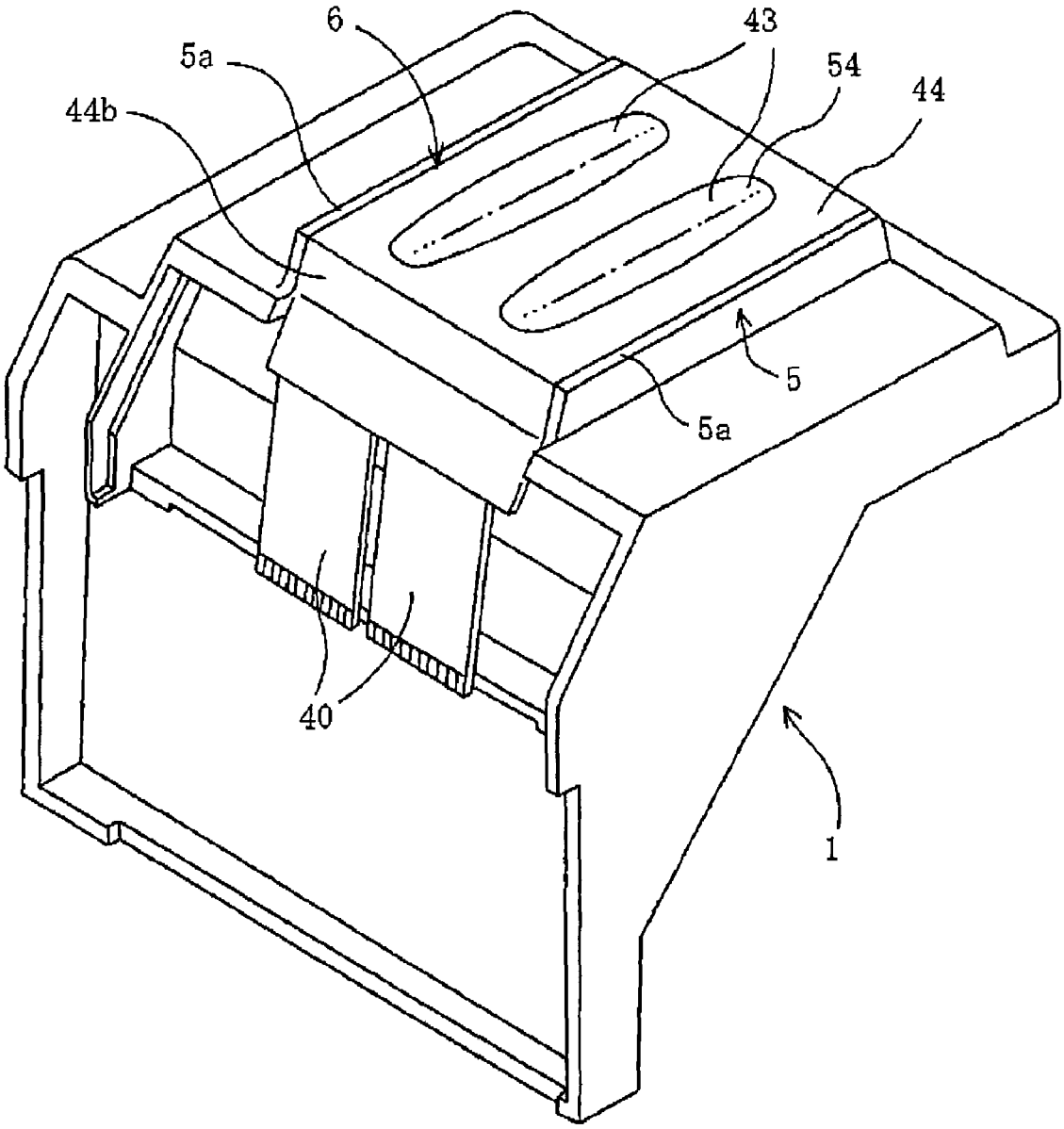
FIG. 1 is a perspective view of an ink jet printer head to which the present invention is applied, the printer head taking an inverted position to show its nozzles.
Figure 2:
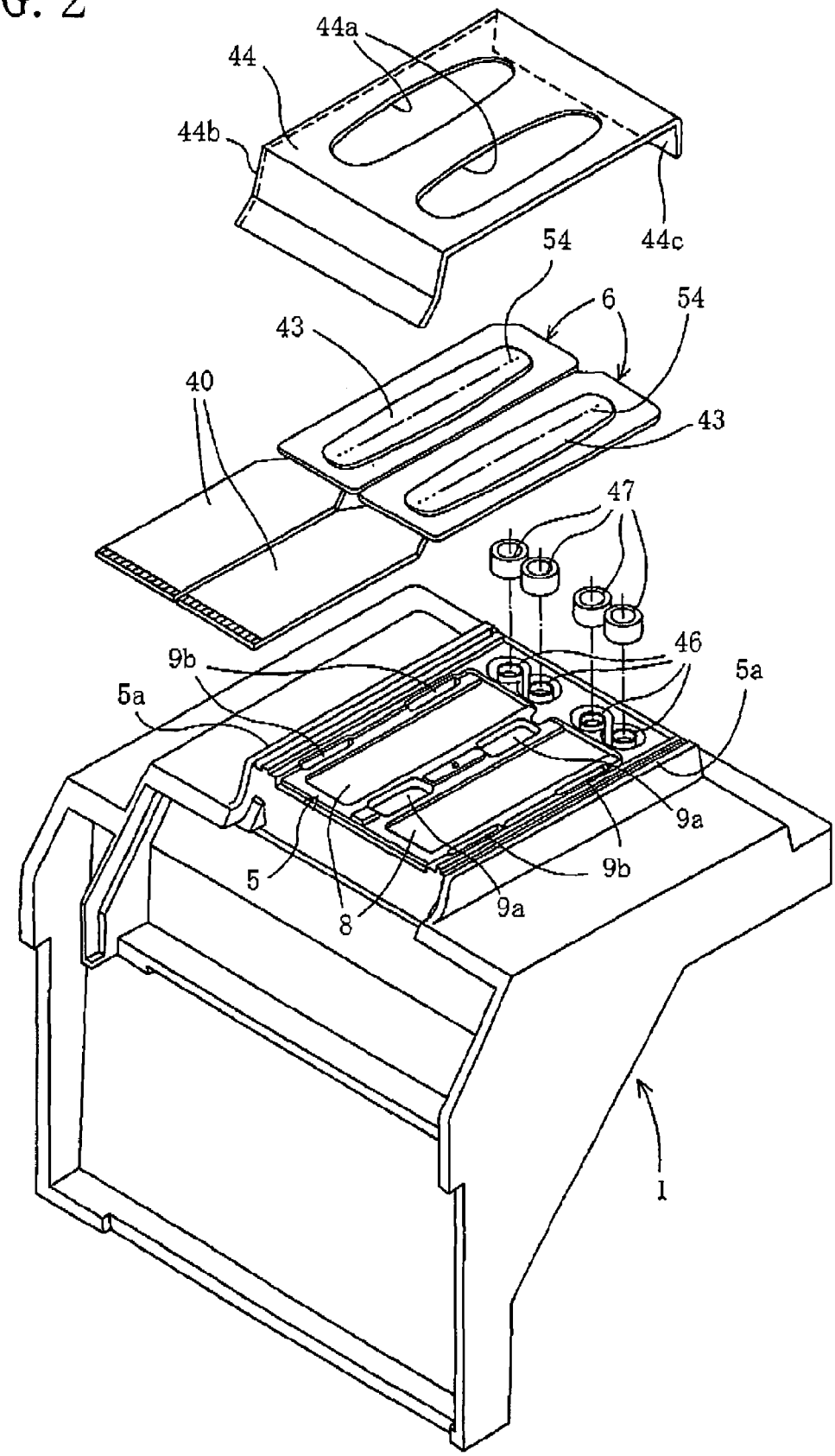
FIG. 2 is a perspective, exploded view of the printer head.
Figure 3:
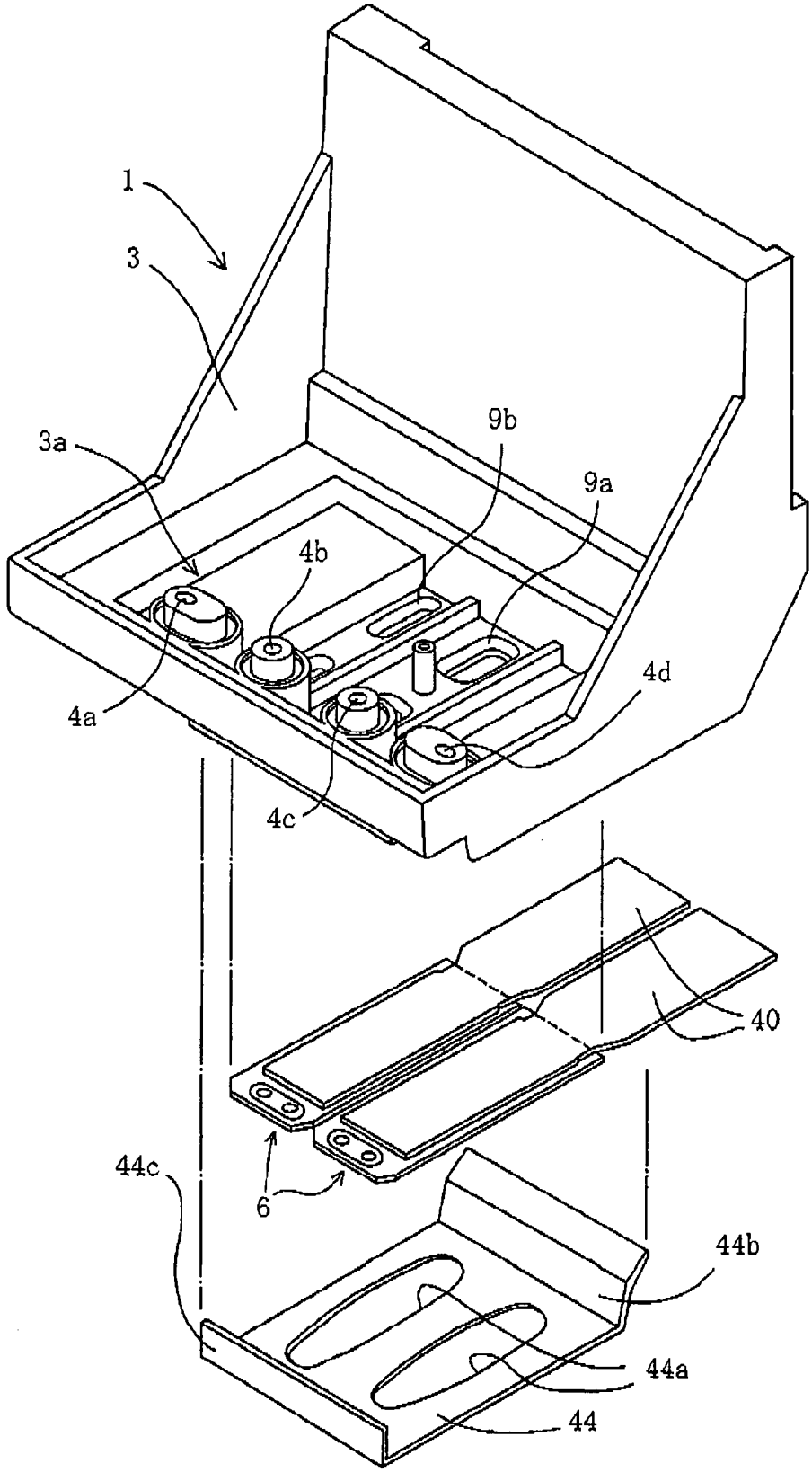
FIG. 3 is a perspective, exploded view of the printer head, the printer head taking a normal position to show an upper portion of its frame member.

Hereinafter, there will be described preferred embodiments of the present invention by reference to the drawings. FIGS. 1, 2, and 3 show a piezoelectric-type ink jet printer head to which the present invention is applied; and FIGS. 4 and 5 show a representative one of two ejector units 6 which are employed by the printer head and to each of which the present invention is also applied.

As shown in those figures, the printer head includes a frame member 1 that is formed, by injection molding, of a synthetic resin such as polyproethylene or polypropylene, and is mounted on a known carriage, not shown, that is movable along a recording medium such as a sheet of paper. As shown in FIG. 3, the frame member 1 has a box-like shape opening upward, and includes a holding portion 3 that holds four ink cartridges, not shown, such that each of the ink cartridges is detachable from the holding portion 3 through the upper opening of the frame member 1. The holding portion 3 has, in one 3*a* of widthwise opposite end portions thereof, four ink supply passages 4*a*, 4*b*, 4*c*, 4*d* that are connectable to respective outlets, not shown, of the four ink cartridges and communicate with respective openings 46 formed in a lower surface of a stepped bottom wall 5 of the frame member 1. An upper surface of the one end portion 3*a* of the holding portion 3 is provided with respective packing members, not shown, that are formed of, e.g., rubber and assure that the four ink supply passages 4*a*–4*d* closely contact the respective outlets of the four ink cartridges. The four openings 46 of the lower surface of the stepped bottom wall 5 are provided with respective packing members 47 that are formed of, e.g., rubber and assure that the four openings 46 closely contact four ink supply holes 19*a* (FIG. 4), in total, of the two ejector units 6.

Figure 15:
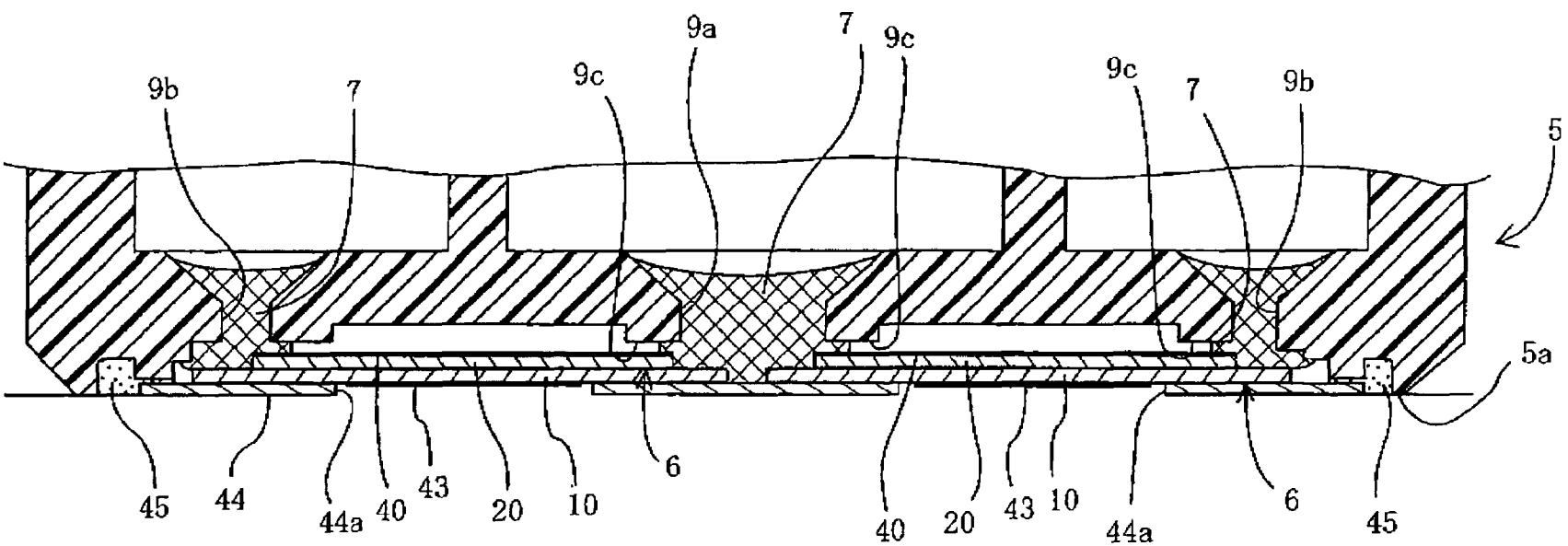
FIG. 15 is an enlarged, cross-sectional view, taken along 15—15 in FIG. 10, showing respective adhered portions of the frame member and the ejector units.
Figure 16:
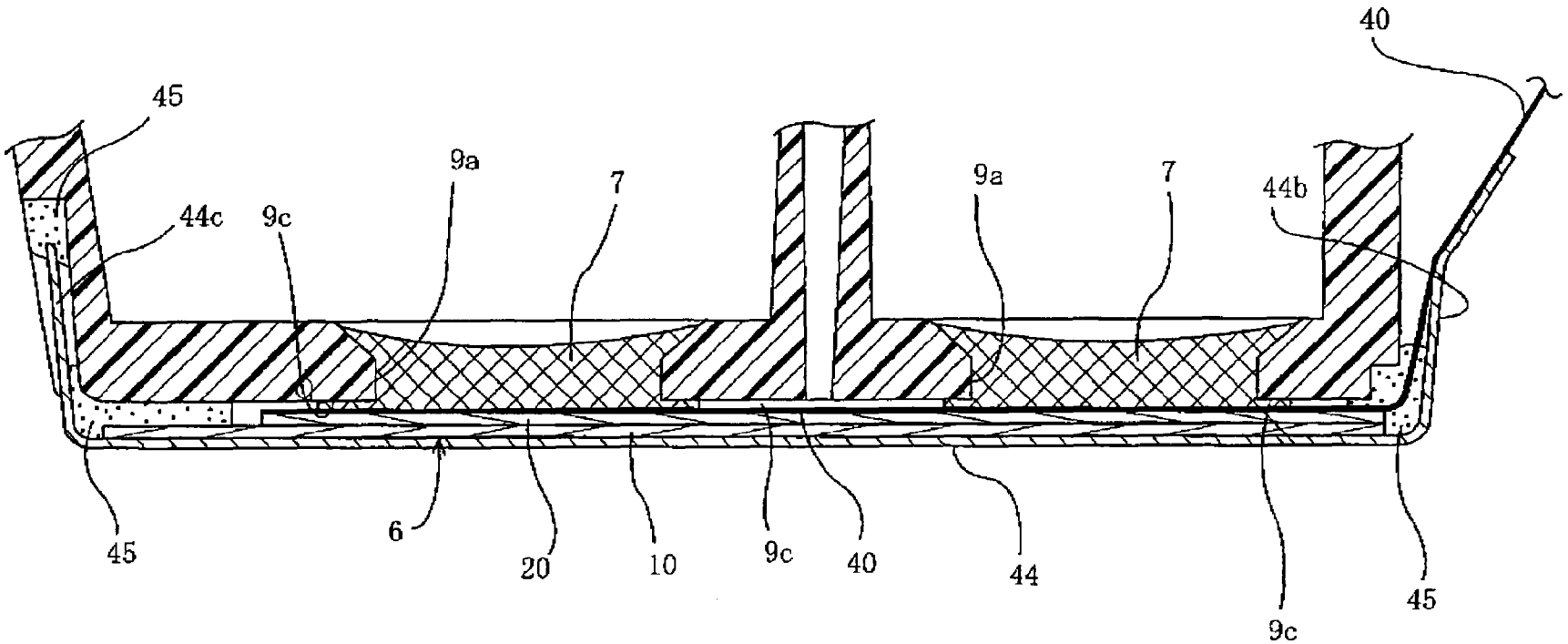
FIG. 16 is an enlarged, cross-sectional view, taken along 16—16 in FIG. 10, respective adhered portions of the frame member and the ejector units.

The stepped bottom wall 5 protrudes downward from the holding portion 3 of the frame member 1, such that the lower surface of the bottom wall 5 is substantially horizontal. The bottom wall 5 includes two stepped support portions 8, 8 that accommodate the two ejector units 6, 6, respectively, such that the two ejector units 6 extend parallel to each other. Each of the two support portions 8 has a plurality of through-holes 9*a*, 9*b* that are formed through the thickness of the bottom wall 5 and are to be filled with a UV-light (i.e., ultraviolet-light) sensitive adhesive 7 (FIGS. 15 and 16). The two central through-holes 9*a* are shared by the two support portions 8.

Figure 4:
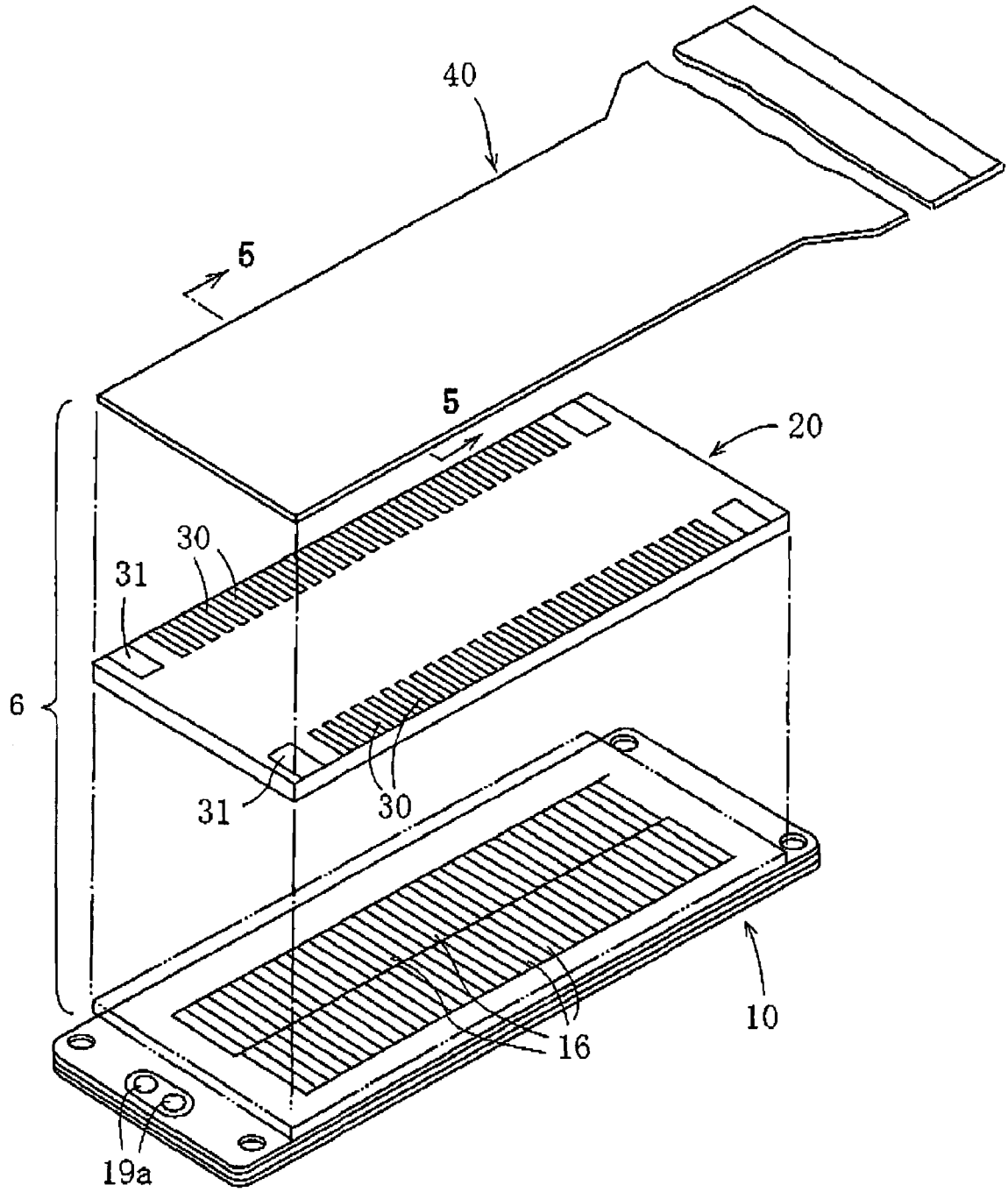
FIG. 4 is a perspective, exploded view of a representative one of two ejector units of the printer head.
Figure 5:
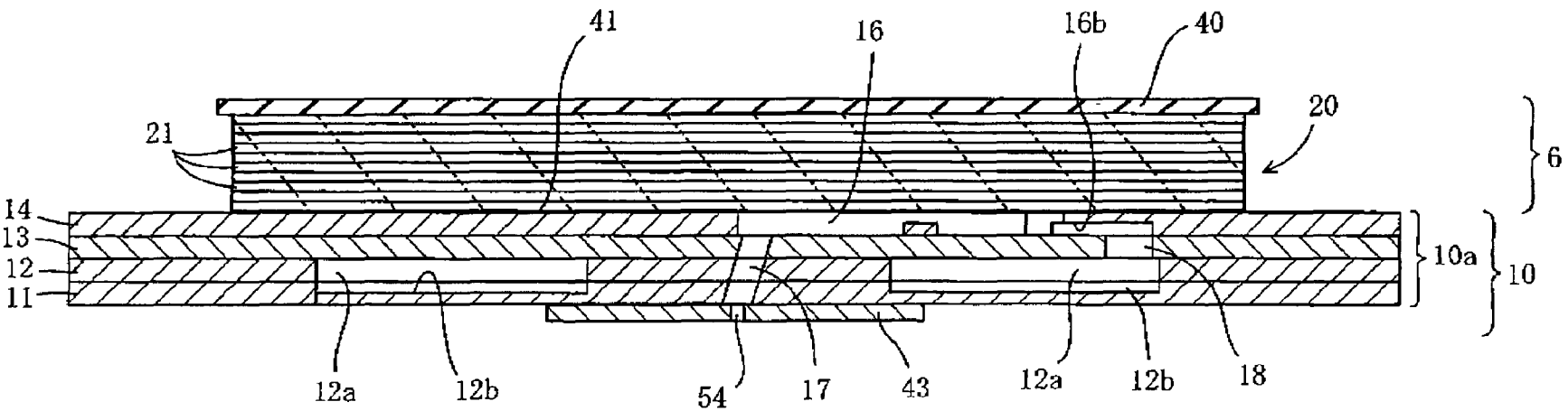
FIG. 5 is an enlarged, cross-sectional view of the ejector unit.

As shown in FIGS. 4 and 5, each of the two ejector units 6 includes a cavity unit 10, a sheet-type piezoelectric actuator 20, and a flexible flat cable 40. The cavity unit 10 consists of a plurality of metallic sheets stacked on each other. The actuator 20 is stacked on, and is adhered to, an upper surface of the cavity unit 10 via an adhesive sheet 41 (FIG. 5) or an adhesive agent. The flat cable 40 is stacked on, and is bonded to, an upper surface of the actuator 20, so that the flat cable 40 electrically connects the actuator 20 to external devices, not shown.

Each ejector unit 6 includes, as a lowermost layer thereof a nozzle sheet 43 (FIG. 6) having a plurality of ink ejection nozzles 54 opening in a lower surface thereof, and ejects a droplet of ink in a downward direction from each of the nozzles 54.

Figure 6:
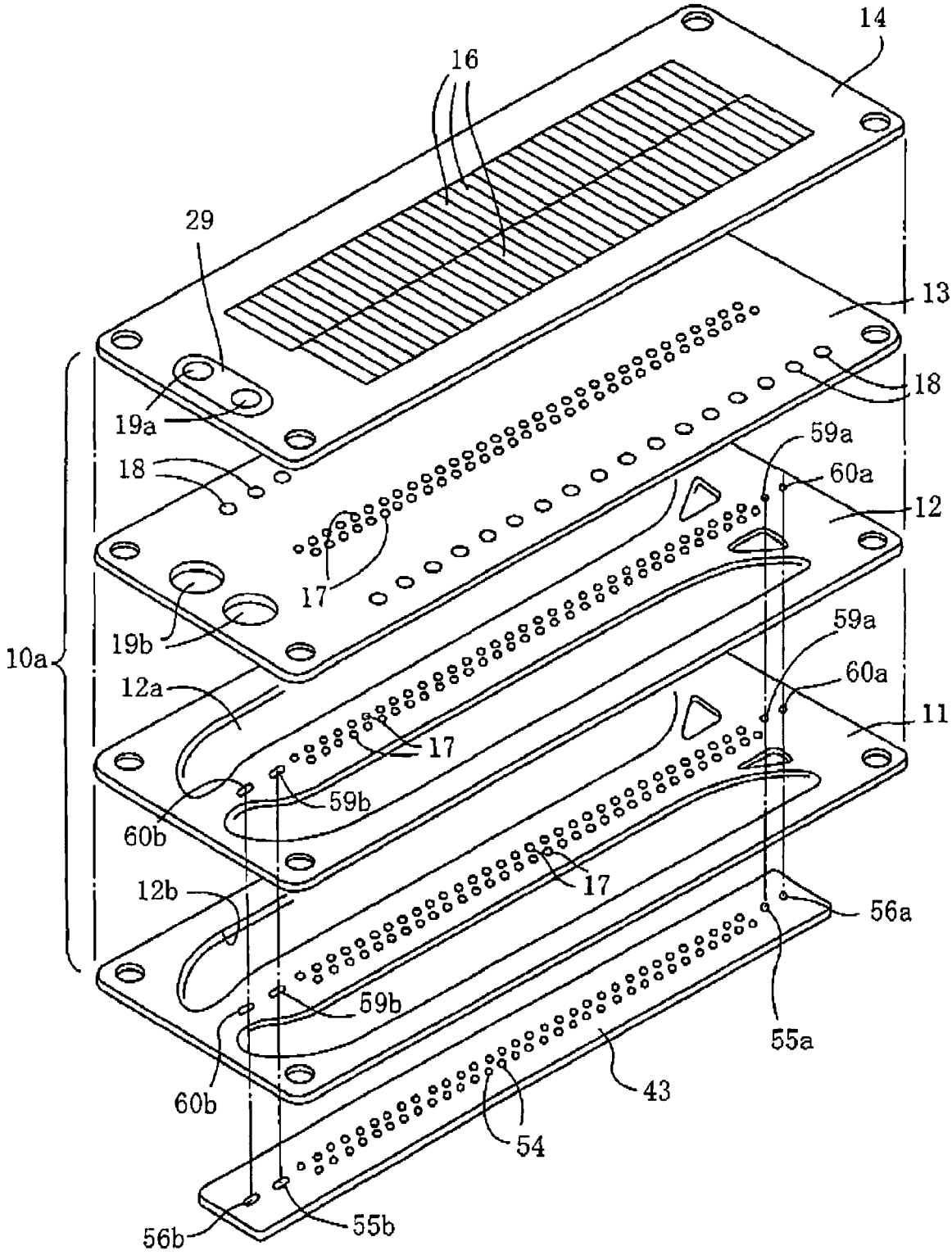
FIG. 6 is a perspective, exploded view of a cavity unit of the ejector unit.
Figure 7:
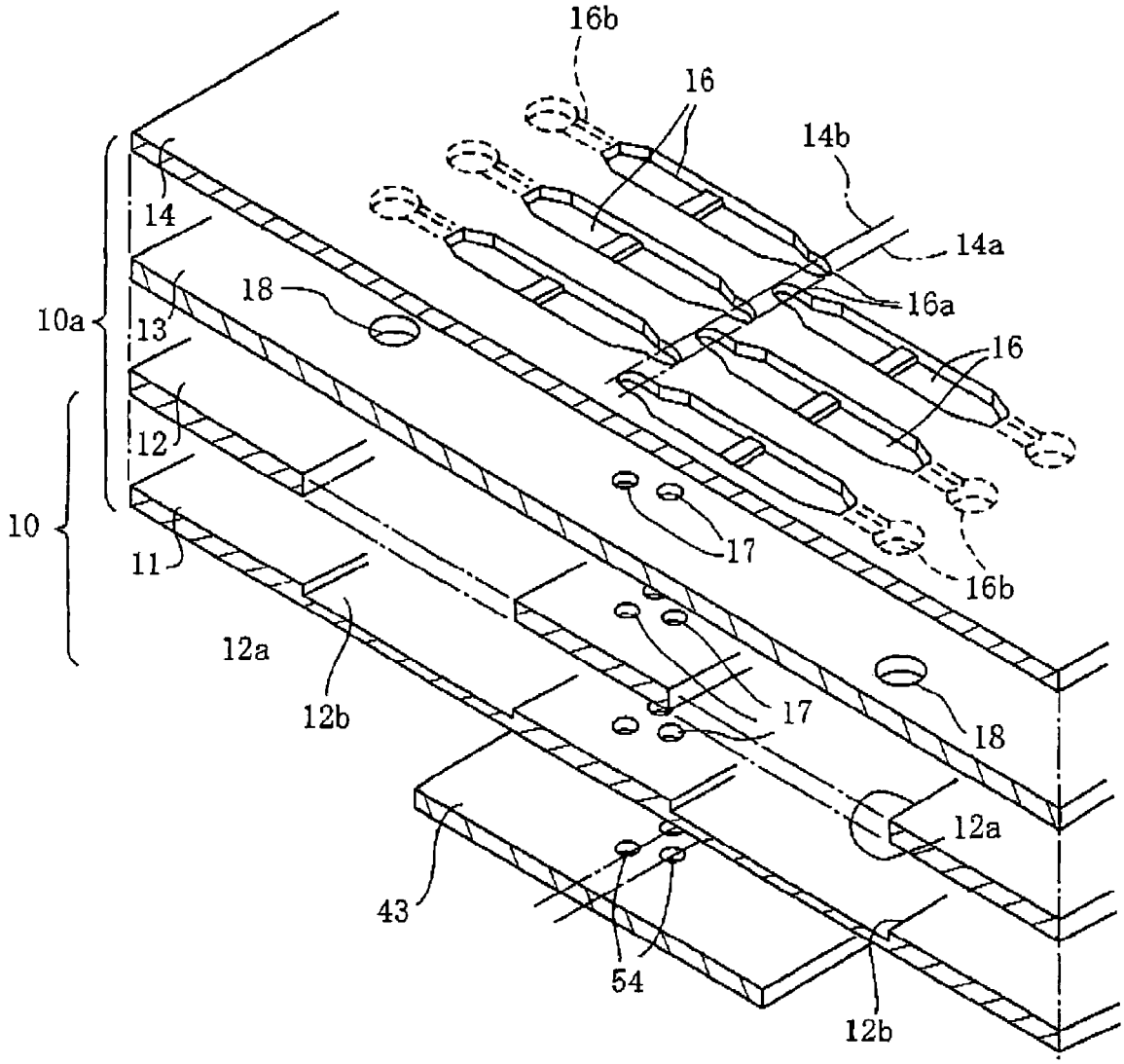
FIG. 7 is an enlarged, cross-sectional view of a portion of the cavity unit.

Next, there will be described in detail each of the cavity unit 10 and the actuator 20 of each ejector unit 6. As shown in FIGS. 5, 6, and 7, the cavity unit 10 includes a channel unit 10*a* consisting of a plurality of sheets stacked on each other, and the nozzle sheet 43 that is adhered, with an adhesive, to a lower surface of the channel unit 10*a* after the channel unit 10*a* has been prepared.

The nozzle sheet 43 is provided by a thin sheet formed of a synthetic resin such as polyimide, and has two arrays of ink ejection nozzles 54 that are arranged in a staggered or zigzag manner in a first direction of the ejector unit 6 (i.e., a lengthwise direction of the same 6). In the present embodiment, each of the nozzles 54 has a diameter of about 25 μm.

The channel unit 10*a* is provided by a stacked body consisting of four thin sheets, i.e., two manifold sheets 11, 12, a spacer sheet 13, and a base sheet 14 that are stacked on, and are adhered with an adhesive to, each other. In the present embodiment, each of the four sheets 11–14 is formed of a 42% nickel alloy steel and has a thickness of from 50 μm to 150 μm.

The two manifold sheets 11, 12 cooperate with each other to define two ink manifolds 12*a*, 12*b*; 12*a*, 12*b* as common ink chambers that respectively accommodate two sorts of inks supplied from corresponding two ink cartridges out of the four ink cartridges each as an ink supply source, via corresponding two ink supply passages out of the four ink supply passages 4*a*, 4*b*, 4*c*, 4*d*, and respectively deliver the two sorts of inks to the two arrays of nozzles 54 via two arrays of pressure chambers 16 as individual ink chambers, described later. The two ink manifolds 12*a*, 12*b* extend in the above-indicated first direction, on opposite sides of the two arrays of nozzles 54, respectively. The two ink manifolds 12*a* of the upper manifold sheet 12 are formed through the thickness of the sheet 12, and the two ink manifolds 12*b* of the lower manifold sheet 11 are formed, as shown in FIG. 7, in an upper surface of the sheet 12 such that the manifolds 12*b* open only upward. The two ink manifolds 12*a*, 12*b*; 12*a*, 12*b* defined by the two manifold sheets 11, 12 are fluid-tightly closed by the spacer sheet 13 when the spacer sheet 13 is stacked on the upper manifold sheet 12.

The base sheet 14 has two arrays of elongate pressure chambers 16 that are arranged in a zigzag manner in a lengthwise direction of the sheet 14, i.e., the first direction of the ejector unit 6 in which the two arrays of nozzles 54 are arranged, such that each of the pressure chambers 16 extends in a second direction of the ejector unit 6, i.e., a widthwise direction thereof perpendicular to a centerline thereof parallel to the lengthwise direction. FIG. 7 shows two reference lines 14*a*, 14*b* that are located on opposite sides of the centerline of the base sheet 14, respectively, and are parallel to the centerline and parallel to each other. Respective inner ends 16*a* of the pressure chambers 16 of one array located on a left-hand side of the centerline are positioned on the right-hand reference line 14*a*; and respective inner ends 16*a* of the pressure chambers 16 of the other array located on a right-hand side of the centerline are positioned on the left-hand reference line 14*b*. Thus, the respective inner ends 16*a* of the pressure chambers 16 of the one array and the respective inner ends 16*a* of the pressure chambers 16 of the other array are located in a zigzag manner along the centerline, and accordingly the two arrays of pressure chambers 16 are arranged in the zigzag manner in the first direction of the ejector unit 6, as shown in FIG. 7, The respective inner ends 16*a* of the pressure chambers 16 formed in the zigzag manner in the base sheet 14 communicate with the ink ejection nozzles 54 formed in the zigzag manner in the nozzle sheet 43, via respective small-diameter through-holes 17 that are formed through the respective thickness of the spacer sheet 13 and the two manifold sheets 11, 12 in a zigzag manner. Each of the through-holes 17 has a diameter that is considerably greater than that of each nozzle 54. Meanwhile, respective outer ends 16*b* of the pressure chambers 16 of the one array communicate with a corresponding one of the two ink manifolds 12*a*, 12*b*; 12*a*, 12*b* via respective through-holes 18 formed in one of left-hand and right-hand portions of the base sheet 14; and respective outer ends 16*b* of the pressure chambers 16 of the other array communicate with the other ink manifolds 12*a*, 12*b* via respective through-holes 18 formed in the other of the left-hand and right-hand portions of the base sheet 14.

As shown in FIG. 7, the respective outer ends 16*b* of the pressure chambers 16 of the two arrays are formed in a lower surface of the base sheet 14, such that the outer ends 16*b* open only downward. Owing to this feature, when the actuator 20 is operated to apply a pressure to an arbitrary pressure chamber 16, the ink present in the pressure chamber 16 is prevented from returning to the corresponding ink manifold 12*a*, 12*b*, and the speed of ejection of ink from the corresponding nozzle 54 is increased. The uppermost base sheet 14 has, in one of lengthwise opposite end portions thereof, two ink supply holes 19*a* that are covered with a filter 29 for removing dust from the two sorts of ink supplied from the corresponding two ink cartridges located above the base sheet 14. The spacer sheet 13 provided underneath the base sheet 14 has, in one of lengthwise opposite end portions thereof, two ink supply holes 19*b* that are aligned with the two ink supply holes 19*a*, respectively.

Thus, each of the two sorts of inks flowing from the two ink supply holes 19*a* of the base sheet 14 and the two ink supply holes 19*b* of the spacer sheet 13, into a corresponding one of the two ink manifolds 12*a*, 12*b*; 12*a*, 12*b* each as part of an ink channel, is delivered from the one ink manifold to each of the pressure chambers 16 of a corresponding one of the two arrays, and reaches the nozzle 54 corresponding to the each pressure chamber 16 via the through-holes 17 of the sheets 13, 12, 11, as shown in FIGS. 5 and 6.

Figure 8:
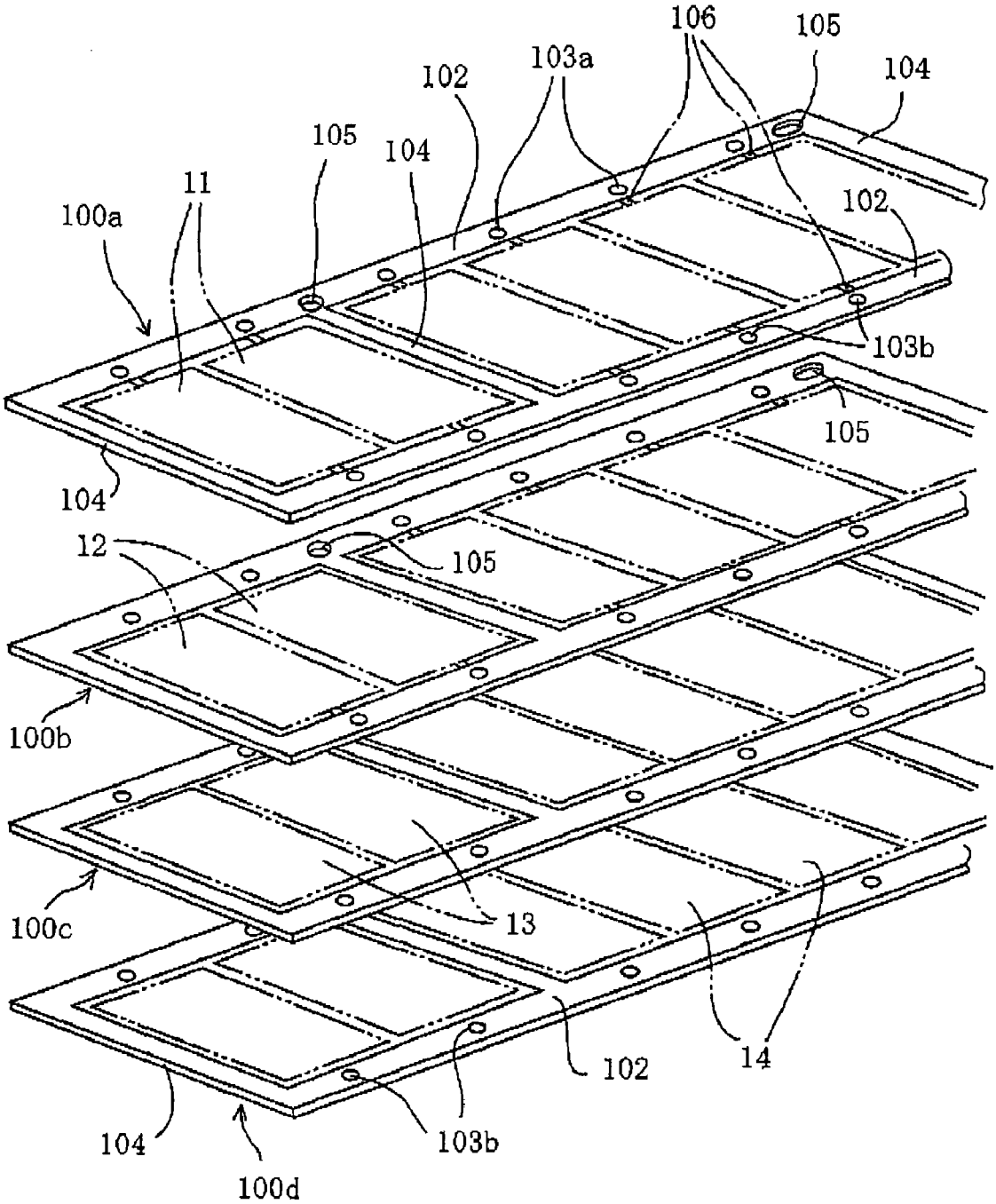
FIG. 8 is a view for explaining a manner in which a channel unit of the cavity unit is assembled.

Next, there will be described a method of preparing the channel unit 10*a*. As shown in FIG. 8, in this method, four lead frames 100*a*, 100*b*, 100*c*, 100*d* are stacked on, and are fixed by adhesion to, each other. Each of the four lead frames 100*a*–100*d* supports sheet members of a corresponding one of the four sorts of sheet members 11, 12, 13, 14, each given in the form of a thin sheet having a prescribed shape or pattern, such that the sheet members are arranged at a regular interval of distance in a lengthwise direction of the each lead frame. More specifically described, the lowermost lead frame 100*d* supports a plurality of base sheets 14 each employed in the above-described embodiment, such that the base sheets 14 are arranged at a predetermined interval of distance in the lengthwise direction of the frame 100*d*. Each of the four lead frames 100*a*–100*d* includes two long-side portions 102, 102, and a plurality of tie bars 104 that connect between the two long-side portions 102 at an appropriate interval of distance. Likewise, the second lowermost lead frame 100*c* supports a plurality of spacer sheets 13 such that the spacer sheets 13 are arranged at the same distance as indicated above; the second uppermost lead frame 100*b* supports a plurality of lower manifold sheets 12 such that the manifold sheets 12 are arranged at the same distance as indicated above; and the uppermost lead frame 100*a* supports a plurality of upper manifold sheets 11 such that the manifold sheets 11 are arranged at the same distance as indicated above. Each of the two long-side portions 102 of each lead frame 100*a*–100*d* has a plurality of positioning holes 105 at an appropriate interval of distance in the lengthwise direction of the each frame. Each of the sheet members 11, 12, 13, 14 is connected to the two long-side portions 102 by two connection portions 106 each having a small width.

The four lead frames 100*a*–100*d* are stacked on each other, either in a normal manner in which the lowermost layer of the stacked body is the manifold sheet 11 and the uppermost layer of the same is the base sheet 14 as in the manner, shown in FIG. 5, in which the cavity unit 10 is used such that the nozzles 54 open downward, or in an upside-down manner in which the lowermost layer of the stacked body is the base sheet 14 and the uppermost layer of the same is the manifold sheet 11.

Before the four lead frames 100*a*–100*d* are stacked on each other, an adhesive is applied to each of respective surfaces of the sheet members 11–14, supported by the frames 100*a*–100*d*, that are to be stacked on each other. For example, the adhesive may be applied such that the adhesive is applied in advance to a planar surface of a jig, so as to form a thin layer of the adhesive, and then each one of the respective surfaces of the sheet members 11–14 to be stacked on each other is contacted with the thin layer of adhesive. Thus, regarding each base sheet 14, the adhesive can be transferred to a solid surface of the base sheet 14 that is other than the holes or recesses thereof i.e., the pressure chambers 16 including the outer ends 16*b* thereof. Otherwise, an adhesive may be applied in advance to an outer circumferential surface of a roller, so as to form a thin layer of the adhesive, and then each one of the respective surfaces of the sheet members 11–14 to be stacked on each other may be contacted with the outer surface of the roller, so as to transfer the adhesive from the roller to the each surface.

Then, positioning pins, not shown, are inserted in the positioning holes 105 of the lead frames 100*a*–100*d*, and a pinching or pressing force is applied to the lowermost lead frame 100*d* and the uppermost lead frame 100*a*, so as to apply a pressure to the sheet members 11–14 and thereby cause the sheet members 11–14 to be adhered and fixed to each other. Thus, a plurality of channel units 10*a* each of which consists of four sheet members 11–14 stacked on, and adhered to, each other is prepared.

Subsequently, two operations are carried out; the first operation is to adhere the nozzle sheet 43 to the channel unit 10*a* so as to form the cavity unit 10, and the second operation is to adhere the two ejector units 6 each of which is prepared by adhering the piezoelectric actuator 20 to an upper surface of the cavity unit 10, to a lower surface of the frame member 1. To this end, as shown in FIG. 6, the nozzle sheet 43 has, in the lengthwise opposite end portions thereof, two first positioning holes 55*a*, 55*b*, respectively, and additionally has two second positioning holes 56*a*, 56*b*, respectively. That is, the two first positioning holes 55*a*, 55*b*, or the two second positioning holes 56*a*, 56*b* are opposite to each other in the lengthwise direction of the nozzle sheet 43 in which the two arrays of nozzles 54 are arranged, and a straight line connecting between the two first positioning holes 55*a*, 55*b* and a straight line connecting between the two second positioning holes 56*a*, 56*b* are parallel to the lengthwise direction of the sheet 43. The four positioning holes 55*a*, 55*b*, 56*a*, 56*b* are formed using a laser or a press, simultaneously when the nozzles 54 are formed. Therefore, the positioning holes 55*a*, 55*b*, 56*a*, 56*b* enjoy a high accuracy with respect to their positions, dimensions, and degrees of parallelism relative to the nozzles 54.

One 55*a* of the two first positioning holes 55*a*, 55*b* is a circular hole whose diameter is substantially equal to that of one 57*a* of two first positioning pins 57*a*, 57*b* of a first jig, described later; and one 56*a* of the two second positioning holes 56*a*, 56*b* is a circular hole whose diameter is substantially equal to that of one 58*a* of two second positioning pins 58*a*, 58*b* of a second jig, described later. The other first positioning hole 55*b* is an elongate hole which is somewhat elongate along the straight line connecting between the two first positioning holes 55*a*, 55*b* and whose width is equal to a diameter of the other first positioning pin 57*b* of the first jig and to a diameter of the one first positioning hole 55*a*; and the other second positioning hole 56*b* is an elongate hole which is somewhat elongate along the straight line connecting between the two second positioning holes 56*a*, 56*b* and whose width is equal to a diameter of the other second positioning pin 58*b* of the second jig and to a diameter of the one second positioning hole 56*a*. Since the first positioning pin 57*a* is fitted in the first positioning hole 55*a*, or since the second positioning pin 58*a* is fitted in the second positioning hole 56*a*, a corresponding one of the lengthwise opposite end portions of the nozzle sheet 43 is fixed in position relative to the first jig, or the second jig, and accordingly is prevented from being moved out of position relative to the first or second jig in any direction. In addition, even if the distance between the two first positioning holes 55*a*, 55*b* of the nozzle sheet 43, or the distance between the two second positioning holes 56*a*, 56*b* of the same 43 may be somewhat greater or smaller, because of manufacturing errors, than the distance between the two first positioning pins 57*a*, 57*b* of the first jig, or the distance between the two second positioning pins 58*a*, 58*b* of the second jig, respectively, the other first positioning pin 57*b* or the other second positioning pin 58*b* can be fitted in the other first positioning hole 55*b* of the nozzle sheet 43 or the other second positioning hole 56*b* of the same 43, respectively.

The two first positioning holes 55*a*, 55*b* of the nozzle sheet 43 are used once in one of the two operations including the first operation to prepare the cavity unit 10 and the second operation to attach the two ejector units 6 to the frame member 1; and the two second positioning holes 66*a*, 56*b* of the same 43 are used once in the other operation.

The lower manifold sheet 11 adjacent the nozzle sheet 43, and the upper manifold sheet 12 above the lower manifold 11 cooperate with each other to define two first relief holes 59*a*, 59*b* which communicate with the two first positioning holes 55*a*, 55*b* of the nozzle sheet 43, respectively, and two second relief holes 60*a*, 60*b* which communicate with the two second positioning holes 56*a*, 56*b* of the same 43, respectively, as shown in FIG. 6.

The two first relief holes 59*a*, 59*b* have respective cross sections greater than those of the corresponding first positioning holes 55*a*, 55*b*; and the two second relief holes 60*a*, 60*b* have respective cross sections greater than those of the corresponding second positioning holes 56*a*, 56*b*. Each of the first relief hole 59*b* and the second relief hole 60*b* is an elongate hole having a width greater than a width of a corresponding one of the elongate first positioning hole 55*b* and the elongate second positioning hole 56*b*. The four relief holes 59*a*, 59*b*, 60*a*, 60*b* are blind holes that are closed by the spacer sheet 13. Therefore, in case ink should leak from each positioning hole 55, 56 to the corresponding relief hole 59, 60, the ink can be prevented from reaching the piezoelectric actuator 20 and accordingly an electric short circuit of the actuator 20 can be prevented. In addition, in the illustrated embodiment, each of the first and second positioning holes 55*a*, 55*b*, 56*a*, 56*b* is so formed as to be distant from one of the nozzles 54 that is the nearest to the each positioning hole, by not less than 1 mm. Therefore, droplets of ink used in printing can be prevented from remaining in each positioning hole 55, 56 and thereby contaminating the recording sheet of paper. The first and second relief holes 59, 60 may not be formed in the upper manifold sheet 12, i.e., may be formed in only the lower manifold sheet 11.

Each of the four lead frames 100*a*–100*d* has, on two extension lines extended in opposite directions from a longitudinal centerline of each of the corresponding sort of sheet members 11–14, two third positioning holes 103*a*, 103*b*, respectively, for use in positioning the each sheet member 11–14 relative to the first jig, and thereby positioning the channel unit 10*a* consisting of the four sheet members 11–14, relative to the nozzle sheet 43.

Figure 9:
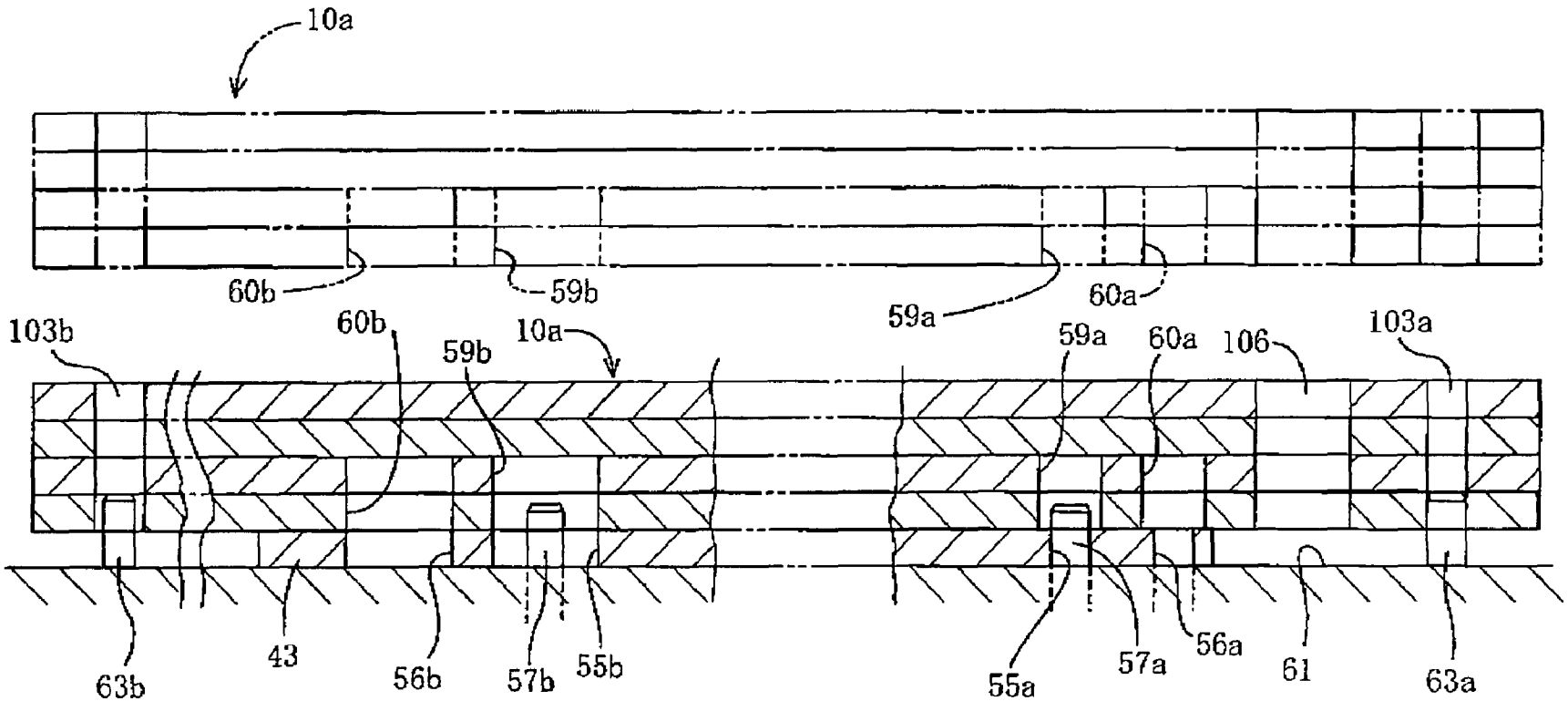
FIG. 9 is a cross-sectional view for explaining a manner in which the channel unit is placed in position relative to a nozzle sheet of the cavity unit.

FIG. 9 shows a manner in which the channel unit 10*a* and the nozzle sheet 43 are adhered to each other. The two first positioning pins 57*a*, 57*b* projecting from a flat plate 61 of the first jig are fitted in the two first positioning holes 55*a*, 65*b* of the nozzle sheet 43, respectively. An adhesive is applied, in advance, to an upper surface of the nozzle sheet 43. Two third positioning pins 63*a*, 63*b* of the first jig are respectively fitted in the two third positioning holes 103*a*, 103*b* of each of the four lead frames 100*a*–100*d* stacked on each other. Thus, the channel unit 10*a* consisting of the four sheet members 11–14 is placed on the nozzle sheet 43, and then a pressure is applied to bond the two elements 10*a*, 43 to each other. Depending upon the sort of the adhesive used, the two elements 10*a*, 43 may be heated while the pressure is applied to the same 10*a*, 43. Since the two first positioning pins 57*a*, 57*b* or the two third positioning pins 63*a*, 63*b* of the first jig have an accurate positional relationship, the channel unit 10*a* and the nozzle sheet 43 bonded to each other enjoy an accurate positional relationship in the cavity unit 10 consisting of the channel unit 10*a* and the nozzle sheet 43. Then, the connection portions 106 are cut off and each cavity unit 10 is taken off the lead frames 100. Next, the piezoelectric actuator 20 is pressed on, and is adhered to, the upper surface of the channel unit 10*a* via the adhesive sheet 41, so as to produce the ejector unit 6.

Meanwhile, as shown in FIGS. 4 and 5, the piezoelectric actuator 20 includes a plurality of piezoelectric sheets 21 which are stacked on each other and each of which has a thickness of about 30 μm. Like a piezoelectric actuator disclosed by Japanese Patent Document No. 4-341853 or its corresponding U.S. Pat. No. 5,402,159, the piezoelectric actuator 20 includes two arrays of elongate individual electrodes, not shown, that are provided, on an upper surface (i.e., a major surface) of every second piezoelectric sheet 21 as counted upward from the lowest piezoelectric sheet 21, at respective locations corresponding to the pressure chambers 16 of the cavity unit 10, and are arranged in the first direction of the ejector unit 6, i.e., in a lengthwise direction of the actuator 20, such that each of the individual electrodes extends, in the second direction of the ejector unit 6 perpendicular to the first direction, to a location in the vicinity of a corresponding one of the two long sides of the actuator 20. The piezoelectric actuator 20 additionally includes a common electrode, not shown, that is provided on an upper surface (i.e., a major surface) of each of the other piezoelectric sheets 21 and is common to all the pressure chambers 16 of the cavity unit 16. On an upper surface of the uppermost or top piezoelectric sheet 21 of the actuator 20, there are provided two arrays of first surface electrodes 30 which are arranged along the two long sides of the top sheet 21, respectively, and each electrode 30 of which is electrically connected to a corresponding one of the individual electrodes on every second sheet 21, and a plurality of second surface electrodes 31 which are electrically connected to each of the common electrodes, as shown in FIG. 4.

The adhesive sheet 41 in the form of an adhesive layer made of a synthetic resin that does not allow penetration of ink, is applied, in advance, to the entire lower surface of the sheet-type piezoelectric actuator 20, i.e., the entire major surface of the same 20 that is opposed to the pressure chambers 16 of the channel unit 10*a*, and then this piezoelectric actuator 20 is adhered and fixed to the cavity unit 10 such that the individual electrodes of the actuator 20 are opposed to the pressure chambers 16 of the cavity unit 10, respectively. In addition, the flexible flat cable 40 is stacked and pressed on the upper surface of the piezoelectric actuator 20, so that various wiring patterns, not shown, of the flat cable 40 are electrically connected to the surface electrodes 30, 31.

In the ejector unit 6 constructed as described above, when an electric voltage is applied, in the piezoelectric actuator 20, between the individual electrode, provided on each of the above-indicated every second piezoelectric sheets 21, that is opposed to an arbitrary one of the pressure chambers 16, and the common electrode provided on each of the other piezoelectric sheets 21, respective portions of the piezoelectric sheets 21 that are aligned with those individual electrodes in the direction of thickness of the actuator 20 and are opposed to the one pressure chamber 16, are deformed owing to piezoelectric effect in the direction of stacking of the piezoelectric sheets 21. This deformation leads to decreasing the volume of the one pressure chamber 16, thereby ejecting a droplet of ink from the pressure chamber 16 via the nozzle 54 and recording an image on the recording sheet of paper.

Figure 10:
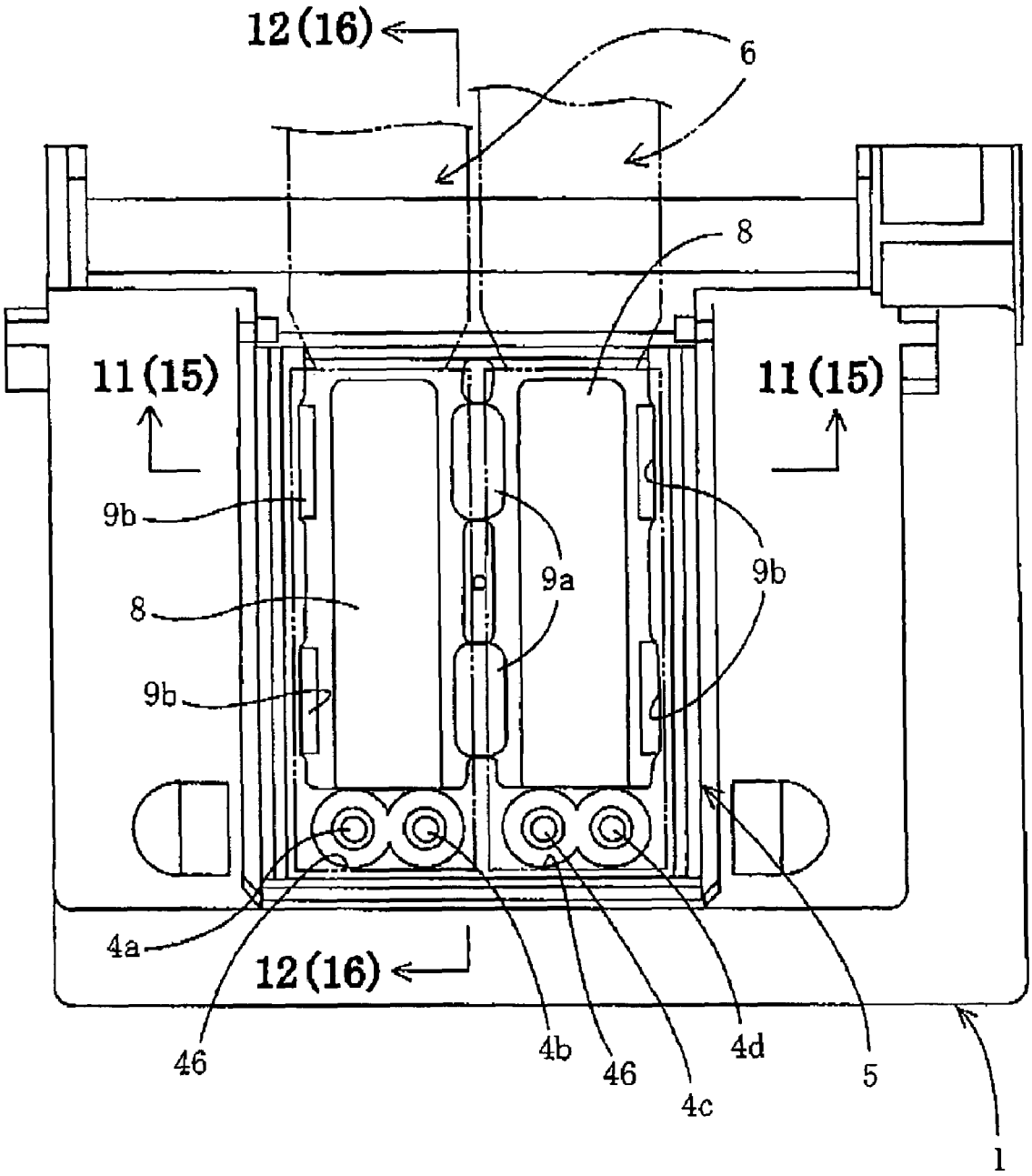
FIG. 10 is a bottom view of a bottom wall of the frame member of the printer head.

Next, there will be described a method of fixing a plurality of (e.g., two) ejector units 6 to the plurality of (e.g., two) stepped support portions 8 of the bottom wall 5 of the frame member 1, such that the two ejector units 6 extend parallel to each other. As shown in FIGS. 2, 3, and 10, the bottom wall 5 has, for each ejector unit 6, four through-holes 9*a*, 9*b* at respective locations corresponding to respective portions of the each ejector unit 6 in respective vicinities of four corners thereof. In the present embodiment, each of the two through-holes 9*a*, 9*a* is formed, along respective one sides (i.e., respective long sides) of the two stepped support portions 8, 8 that are adjacent each other, so wide that the each wide through-hole 9*a* is aligned with respective portions of respective back surfaces of the two ejector units 6, 6.

Figure 11:
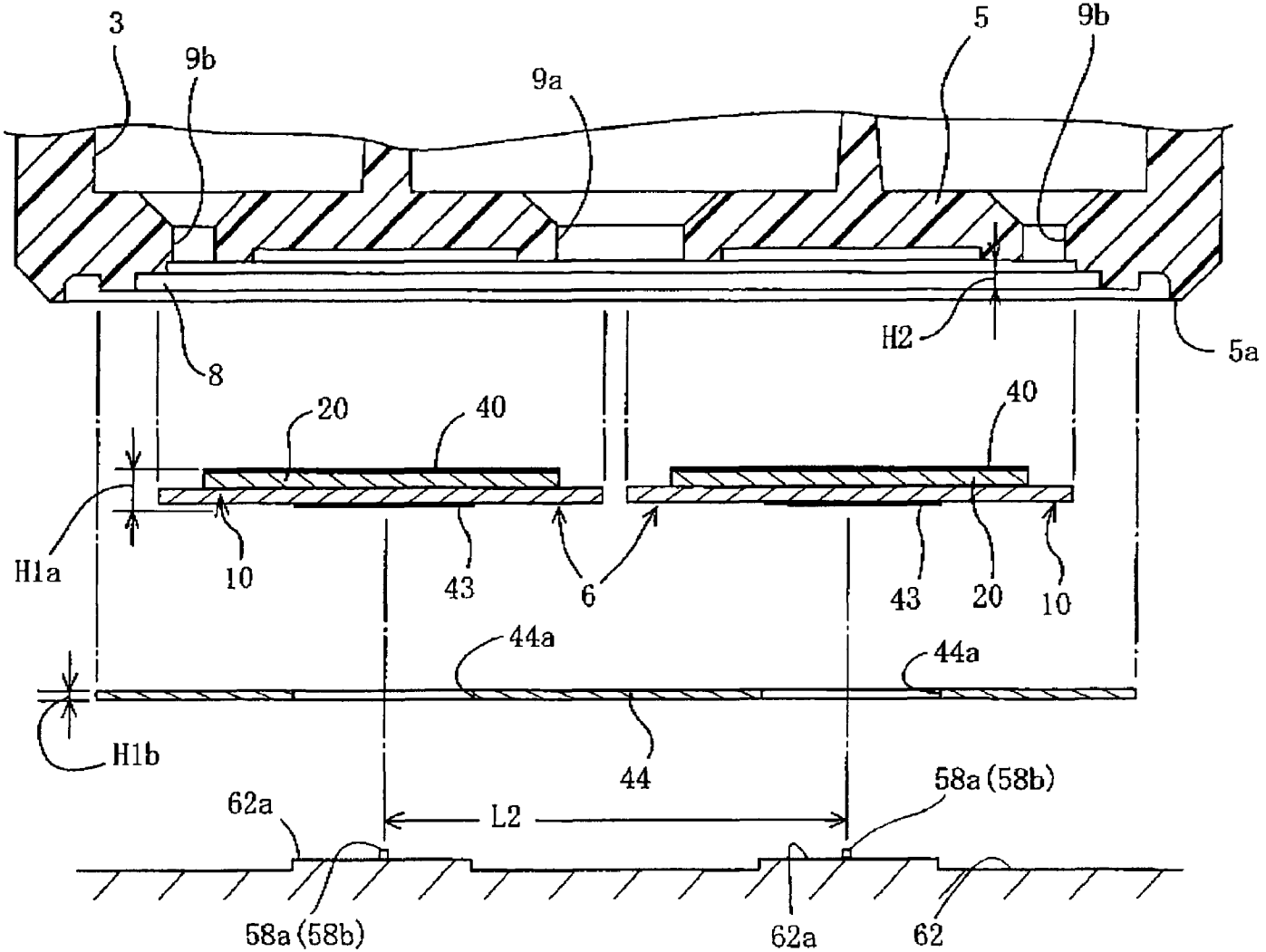
FIG. 11 is an enlarged, cross-sectional view, taken along 11—11 in FIG. 10, for explaining a manner in which the frame member and the ejector units are assembled with each other.
Figure 12:
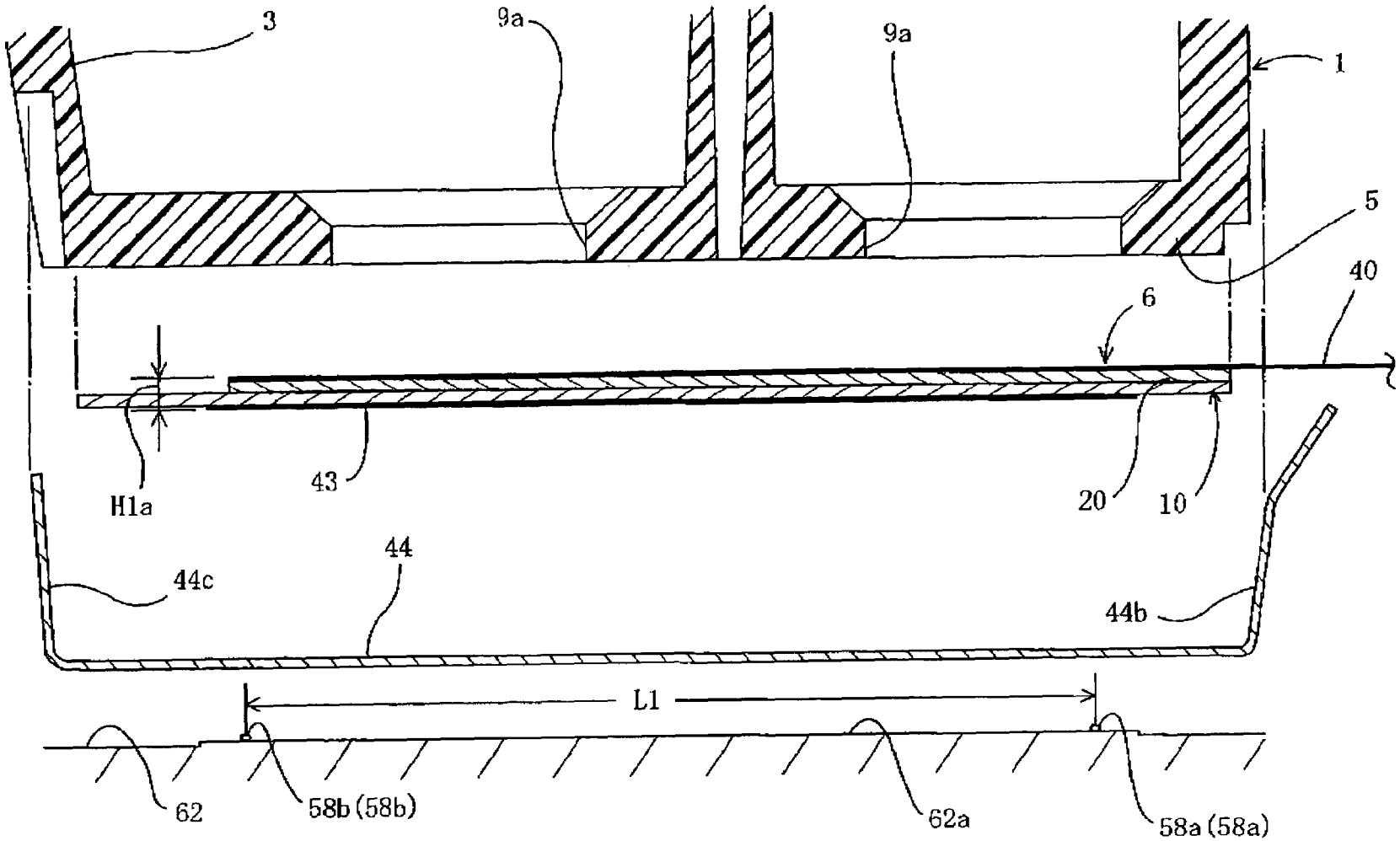
FIG. 12 is an enlarged, cross-sectional view, taken along 12—12 in FIG. 10, for explaining the manner in which the frame member and the ejector units are assembled with each other.

First, a second jig having, on a flat plate 62 thereof, two pairs of second positioning pins 58*a*, 58*b*; 58*a*; 58*b* for positioning two ejector units 6 relative to each other, is prepared. The second jig needs to be able to accurately position the respective nozzle arrays 54, 54 of the two nozzle sheets 43, 43 such that the respective nozzle arrays 54, 54 extend parallel to each other and are distant from each other by a predetermined distance. To this end, as shown in FIG. 12, the second jig has, for each of two ejector units 6, two second positioning pins 58*a*, 58*b* at respective positions corresponding to the two positioning holes 56*a*, 56*b* of the nozzle sheet 43 of the each ejector unit 6 that are distant from each other by a predetermined distance, L1. In addition, as shown in FIG. 11, the second jig has two second positioning pins 58*a*, 58*a*, or two second positioning pins 58*b*, 58*b*, at respective positions distant from each other by a predetermined distance, L2, so that the respective nozzle arrays 54 of the two ejector units 6 extend parallel to each other and are distant from each other by the distance L2.

The flat plate 62 of the second jig has two stepped portions 62*a* around the two pairs of second positioning pins 58*a*, 58*b* that fit in the respective pairs of second positioning holes 66*a*, 56*b* of the respective nozzle sheets 43 of the two ejector units 6. Each of the two stepped portions 62*a* projects upward from the remaining portion of the flat plate 62, and is smaller, in its plan view, than each of two openings 44*a* of a cover plate 44. First, the cover plate 44 is placed on the flat plate 62 of the second jig, such that the two stepped portions 62*s* are inserted in the two openings 44*a*, respectively.

Figure 13A:
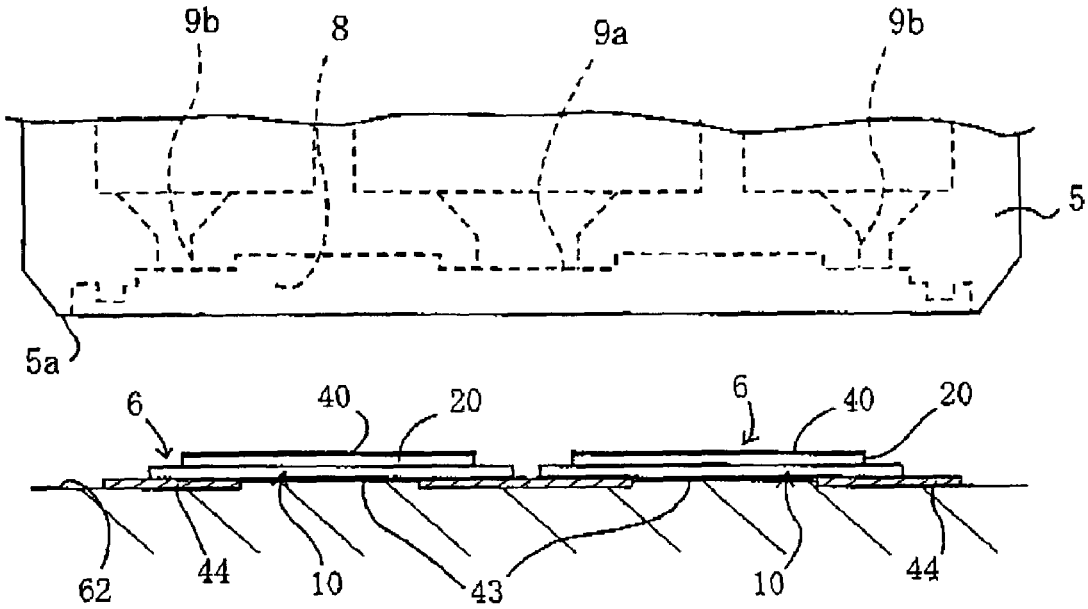
FIG. 13A is an elevation view showing the ejector units that are placed in position relative to each other.
Figure 14:
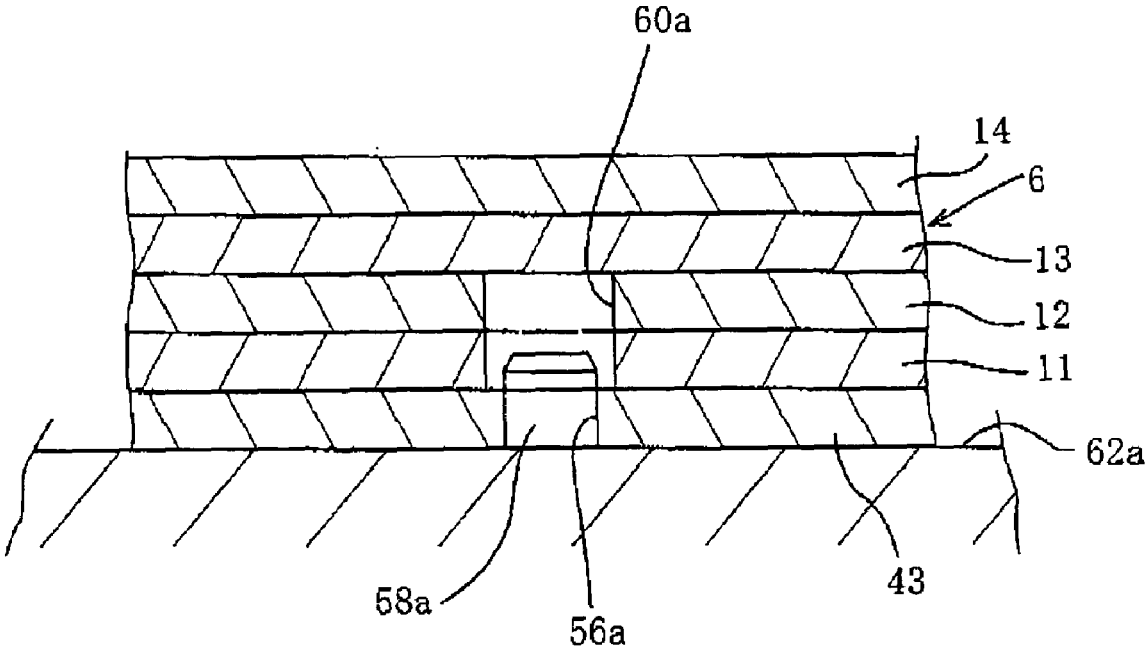
FIG. 14 is an enlarged, cross-sectional view for explaining a positional relationship of positioning pins, positioning holes, and blind holes as relief holes in the state in which the ejector units are placed on the jig.

Then, with the nozzle sheet 43 of each of the two ejector units 6 being directed downward to face the corresponding stepped portion 62*a* of the flat plate 62 of the second jig, the second positioning pins 58*a*, 58*b* of the second jig are fitted in the two second positioning holes 56*a*, 56*b* provided on opposite sides of the two arrays of nozzles 54 of the nozzle sheet 43 that are opposite to each other in the lengthwise direction of the sheet 43, as shown in FIG. 13A and FIG. 14. Thus, the two ejector units 6, 6 are set on the second jig such that the respective nozzle arrays 54 of the two ejector units 6, 6 are parallel to each other, and are aligned with each other in the widthwise direction of each of the ejector units 6, 6, as shown in FIG. 10.

Though the height of the second positioning pins 58*a*, 58*b* of the second jig is greater than the thickness of the nozzle sheet 43, the second positioning pins 58*a*, 58*b* are not interfered with by each ejector unit 6, since at least the sheet member (i.e., the lower manifold sheet 11) adjacent the nozzle sheet 43 has the relief holes 60*a*, 60*b*. In addition, since the respective diameters of the second positioning pin 58*a* and the second positioning hole 56*a* are made equal to each other and accordingly rattling of each ejector unit 6 is prevented, the lower surface of the nozzle sheet 43 of each ejector unit 6 can be held in contact with the upper surface of the flat plate 62 of the second jig. Thus, the direction in which ink is ejected from each of the nozzles 54 of the nozzle sheet 43 of each ejector unit 6 can be so established that the direction is accurately perpendicular to the upper surface of the second jig, i.e., the upper surface of the corresponding stepped portion 62*a* of the same.

In addition, since the straight line connecting between the two second positioning holes 56*a*, 56*b* of each nozzle sheet 43 is parallel to the arrays of nozzles 54 of the each sheet 43, the respective nozzle arrays 54, 54 of the two nozzle sheets 43, 43 can be made accurately parallel to each other and can be made accurately distant from each other by the predetermined distance.

Figure 13B:
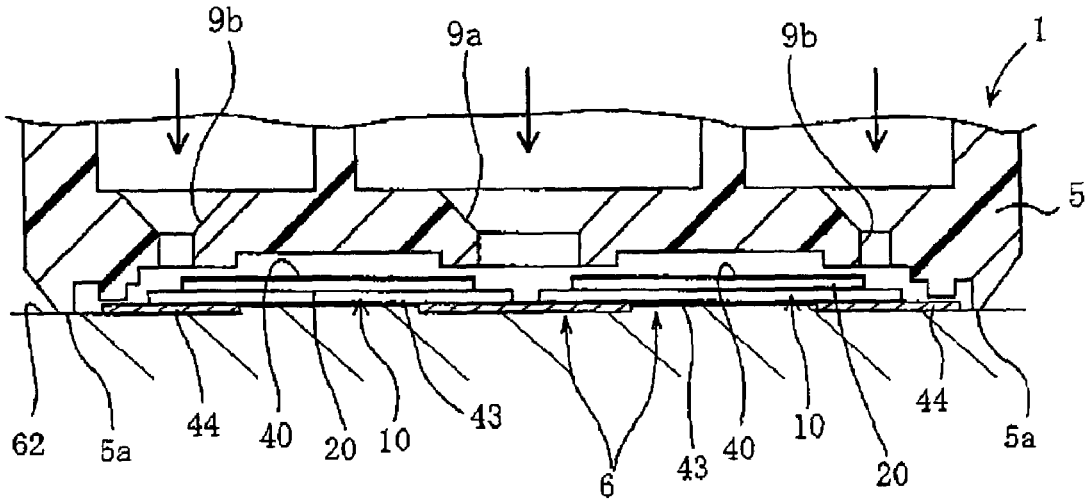
FIG. 13B is a cross-sectional view showing the frame member that is placed in position relative to the ejector units.

Subsequently, the frame member 1 is placed over the two ejector units 6, 6 positioned relative to the second jig, such that the two ejector units 6, 6 are accommodated in respective inner recesses of the two stepped support portions 8, 8 of the bottom wall 5 of the frame member 1. Consequently a lower end of a rib 5*a* of the bottom wall 6 is kept in substantially flush with the lower surface of the cover plate 44. Then, from an upper side of the frame member 1, a viscous UV-light curing adhesive 7, such as a modified-acrylic-resin adhesive, as a sort of quickly curing adhesive is applied, as indicated at downward-directed arrows in FIG. 13B, in the through-holes 9*a*, 9*b* of the bottom wall 5, so as to fill the same 9*a*, 9*b*, and an UV (ultraviolet) light is irradiated from the upper side of the frame member 1 to the UV-light curing adhesive 7 filling the through-holes 9*a*, 9*b*. Thus, the UV-light curing adhesive 7 is cured in a short time (i.e., within several tens of seconds).

If a depth, H2, of each of the two stepped support portions 8 of the bottom wall 5 is somewhat greater than a thickness, H1*a*, of each ejector unit 6 that is equal, as shown in FIG. 11, to a sum of respective thickness values of the nozzle sheet 43, the channel unit 10*a*, the piezoelectric actuator 20, and the flexible flat cable 40, small spaces 9*c* are left between the stepped support portions 8 and the respective upper (or back) surfaces of the ejector units 6, as shown in FIGS. 15 and 16. Since the UV-light curing adhesive 7 filling the small spaces 9*c* is cured within several tens of seconds, the frame member 1 can be fixed to the ejector units 6 under a condition that owing to the frame member 1, undesired external forces are prevented from being unintentionally exerted to any portions of the ejector units 6. A thickness, H1*b*, of the cover plate 44 is so designed as to assure that the ejector units 6 and the cover plate 44 can be accommodated inside the rib 5*a*.

Thus, respective axis lines of the nozzles 54, i.e., respective directions in which ink is ejected from the nozzles 54 can be made accurately perpendicular to the lower surface of the frame member 1, and additionally the respective nozzle arrays 54 of the two ejector units 6, 6 can be kept accurately parallel to each other.

In addition, since the four through-holes 9*a*, 9*b* are formed in the respective vicinities of the four corners of each ejector unit 6 having a rectangular shape in its plan view, an amount of displacement of the each ejector unit 6 out of position because of shrinkage of the adhesive 7 being cured can be minimized.

In addition, since the adhesive 7 is cured at the four positions in the respective vicinities of the four corners of each ejector unit 6, the each ejector unit 6 enjoys another advantage that when the present ink jet printer head is not in use on the printer and when a cap such as a rubber-based cap is pressed on the front surface of the cavity unit 10 so as to closely contact the same 10 for the purpose of preventing drying up of the nozzles 54, the front surface of the cavity unit 10 can be effectively prevented from being adversely deformed.

Moreover, as shown in FIGS. 11 and 15, the two through-holes 9*a* are formed so wide as to be able to face respective one sides of the two ejector units 66 that are juxtaposed with each other. Therefore, the two ejector units 6, 6 can be simultaneously fixed to the frame member 1 by filling, with the UV-light curing adhesive 7, the through-holes 9*a* and causing the UV light to be incident to the adhesive 7. Thus, the operation time can be largely shortened and the production efficiency can be largely improved.

In place of the UV-light curing adhesive 7, a moisture-curing adhesive having a composition analogous with that of the UV-light curing adhesive 7 may be used as the quickly curing adhesive.

As shown in FIGS. 11 and 12, the cover plate 44 is bonded to the frame member 1 when the ejector units 6 are bonded to the frame member 1 using the second jig 62. However, the cover plate 44 may be bonded to cover the ejector units 6 after the ejector units 6 have been fixed to the frame member 1.

Then, a sealing material 45 is used to fill small spaces left between the ejector units 6, the cover plate 44, and the frame member 1. In addition, a material operating as an adhesive as well as a sealing material is applied to either one of respective surfaces of the cover plate 44 and the lower manifold sheet 11 of each ejector unit 6 that are opposed to each other, so that when the each ejector unit 6 is fixed to the frame member 1, that material is interposed between the each ejector unit 6 and the cover plate 44 so as to adhere the two elements 6, 44 to each other.

The cover plate 44 is formed of a thin metallic sheet, and the sealing material 46 is, e.g., a silicone-based adhesive. As shown in FIGS. 15 and 16, a space left between an outer periphery of the cover plate 44 and the frame member 1 is filled with the sealing material 45 and thus the outer periphery of the cover plate 44 is fixed to the frame member 1. More specifically described, a generally U-shaped space left between two long sides of the cover plate 44 and the two ribs 5*a* of the bottom wall 5 and between a free end of a bent portion 44*c* of the cover plate 44 and a side surface of the frame member 1 is filled with the sealing material 45, and a space left between another bent portion 44*b* of the cover plate 44 and the flexible flat cable 40 and a space left between the cable 40 and another side surface of the frame member 1 are filled with the sealing material 45, as shown in FIG. 16. A space left between an inner periphery of each of the two openings 44*a* of the cover plate 44 and the front surface of a corresponding one of the two ejector units 6 is filled with the above-indicated material for adhering the cover plate 44 and the ejector units 6 to each other. Therefore, the space left between the two ejector units 6 is covered by the cover plate 44, and the space left between the frame member 1 and the outer periphery of each of the two ejector units 6 is filled with the sealing material 45 and is covered by the cover plate 44. Thus, ink, paper, dust, etc. are effectively prevented from entering the spaces 9*c* between the frame member 1 and the ejector units 6, and an electric short circuit is prevented from occurring to the electric connection portions between the piezoelectric actuator 20 and the flexible flat cable 40. In addition, since the bent portion 44*b* of the cover plate 44 can define a direction in which the flexible flat cable 40 is led and can additionally protect the same 40.

In a modified form of the cavity unit 10, a damper sheet having a recess whose shape is substantially identical in its plan view, with that of each ink manifold 12*a*, 12*b*, is adhered and fixed to the lower surface of the lower manifold sheet 11 that is opposed to the nozzle sheet 48.

In another modified form of the cavity unit 10, the half-etched restrictor of the outer end portion 16*b* of each pressure chamber 16 is omitted and, instead, three spacer sheets are interposed between the upper manifold sheet 12 and the base plate 14. In this modified form, an elongate restrictor is formed in the intermediate one of the three spacer sheets such that the elongate restrictor extends substantially parallel to the pressure chamber 16 along the plane of the intermediate spacer sheet, and a communication hole is formed through the thickness of the upper spacer sheet so that ink is introduced from the ink manifold 12*a* to the outer end of the pressure chamber 16 via the elongate restrictor.

The number of the ejector units 6 fixed to the frame member 1 may be three, four, or more. The cavity unit 10 or the channel unit 10*a* of each ejector unit 6 may be formed of a metallic material or a ceramic material. The present ink jet printer may employ, as its drive device, a different sort of actuator than the sheet-type piezoelectric actuator 20. Otherwise, the present ink jet printer may employ a diaphragm that partly defines each pressure chamber 16 and is vibrated by static electricity to eject a droplet of ink from the corresponding nozzle 54. Moreover, the frame member 1 may be modified such that the modified frame member does not support any ink cartridges and the ink supply passages 4*a*–4*d* thereof are supplied with ink from an ink tank that is not supported by the carriage, via respective tubes.

It is to be understood that the present invention may be embodied with various changes and improvements that may occur to a person skilled in the art, without departing from the spirit and scope of the invention defined in the appended claims.

What is claimed is:

1. A method of manufacturing an ink jet printer head including (a) a plurality of cavity units each of which has a plurality of nozzles, a plurality of ink chambers which communicate with the plurality of nozzles, respectively, and in each of which an ink is accommodated, and a plurality of ink channels communicating with the plurality of nozzles via the plurality of ink chambers, respectively, and (b) a plurality of actuators each of which applies an energy to each of the ink chambers of a corresponding one of the cavity units so as to eject a droplet of the ink from a corresponding one of the nozzles via a corresponding one of the ink channels, the method comprising the steps of:

preparing a plurality of nozzle sheets each of which has the plurality of nozzles, two first positioning holes, and two second positioning holes, preparing a plurality of channel units each of which has the plurality of ink chambers to accommodate the ink and communicate with the plurality of nozzles, respectively, of a corresponding one of the nozzle sheets, and the plurality of ink channels to communicate with the plurality of nozzles of said corresponding nozzle sheet via the plurality of ink chambers, respectively, causing two first positioning pins of a first jig to fit in the two first positioning holes of said each of the nozzle sheets so as to position said each nozzle sheet relative to the first jig, fixing said each nozzle sheet positioned relative to the first jig, and a corresponding one of the channel units that is positioned relative to the first jig, to each other, so as to provide a corresponding one of the cavity units, causing a first pair of second positioning pins of a second jig to fit in the two second positioning holes of the nozzle sheet of a first one of the cavity units, and causing a second pair of second positioning pins of the second jig to fit in the two second positioning holes of the nozzle sheet of a second one of the cavity units, so that the first and second cavity units are positioned relative to the second jig and are thereby positioned relative to each other, and fixing the first and second cavity units positioned relative to each other, to a frame member.

2. The method according to claim 1, wherein the step of preparing the channel units comprises preparing the channel units each of which has two first relief holes to communicate, when said each channel unit and said corresponding one of the nozzle sheets are fixed to each other, with the two first positioning holes of said corresponding nozzle sheet and allow the two first positioning pins of the first jig to enter the two first relief holes via the two first positioning holes, respectively, and additionally has two second relief holes which communicate, in a state in which said each channel unit and said corresponding nozzle sheet are fixed to each other, with the two second positioning holes of said corresponding nozzle sheet and allow a corresponding one pair of second positioning pins out of the first and second pairs of second positioning pins of the second jig to enter the two second relief holes via the two second positioning holes, respectively.

3. The method according to claim 2, wherein the step of preparing the channel units comprises preparing the channel units said each of which has the first and second relief holes each of which has a cross section greater than a cross section of a corresponding one of the first and second positioning holes of said corresponding one nozzle sheet, said each channel unit additionally having two third positioning holes at respective positions distant from each other in a reference direction in which the nozzles of said corresponding nozzle sheet are arranged, and wherein the step of causing the two first positioning pins of the first jig to fit in the two first positioning holes of said corresponding nozzle sheet comprises causing two third positioning pins of the first jig to fit in the two third positioning holes of said each channel unit so as to position said each channel unit relative to the first jig and thereby position said each channel unit and said corresponding nozzle sheet relative to each other.

4. The method according to claim 1, further comprising a step of preparing the frame member having at least one ink supply passage through which the ink is supplied from at least one ink supply source to the first and second cavity units.

5. The method according to claim 1, wherein the step of preparing the nozzle sheets comprises preparing the nozzle sheets each of which has the plurality of nozzles arranged in a reference direction, and has the two first positioning holes in two end portions thereof, respectively, that are opposite to each other in the reference direction, and additionally has the two second positioning holes in the two end portions thereof, respectively.

6. The method according to claim 5, wherein one of the two first positioning holes is a circular hole, and the other first positioning hole is an elongate hole having a width substantially equal to a diameter of the one of the two first positioning holes, and wherein one of the two second positioning holes is a circular hole and the other second positioning hole is an elongate hole having a width substantially equal to a diameter of the one of the two second positioning holes.

7. The method according to claim 1, wherein the step of preparing the channel units comprises preparing the channel units each of which has two first blind holes to communicate, when said each channel unit and said corresponding one of the nozzle sheets are fixed to each other, with the two first positioning holes of said corresponding nozzle sheet, respectively, and allow the two positioning pins of the first jig to enter the two first blind holes via the two first positioning holes, respectively, and additionally has two second blind holes to communicate, in a state in which said each channel unit and said corresponding nozzle sheet are fixed to each other, with the two second positioning holes of said corresponding nozzle sheet, respectively, and allow a corresponding one pair of second positioning pins out of the first and second pairs of second positioning pins of the second jig to enter the two second blind holes via the two second positioning holes, respectively.

8. The method according to claim 7, wherein each of the first and second blind holes has a cross section greater than a cross section of a corresponding one of the first and second positioning holes.

9. The according to claim 7, wherein the step of preparing the channel units comprises preparing the channel units each of which includes a base sheet having the ink chambers, and a plurality of channel sheets which cooperate with each other to define the ink channels and the first and second blind holes, by stacking the base sheet and the channel sheets on each other to provide a stacked body, and wherein the step of fixing said each nozzle sheet and said corresponding channel unit to each other comprises fixing said each nozzle sheet having the nozzles to the stacked body as said corresponding channel unit by inserting the two first positioning pins via the two first positioning holes of said each nozzle sheet, respectively, into the two first blind holes of the stacked body, respectively.

10. The method according to claim 1, wherein the step of fixing the first and second cavity units to the frame member comprises fixing the first and second cavity units to a bottom wall of the frame member such that the first and second cavity units extend parallel to each other.

11. The method according to claim 1, further comprising a step of preparing the frame member having a bottom wall including a plurality of support portions which support respective back surfaces of the first and second channel units such that a plurality of portions of the back surface of each of the first and second channel units are exposed in a plurality of through-holes of the bottom wall, respectively, wherein the step of fixing the first and second cavity units to the frame member comprises fixing the first and second cavity units to the bottom wall of the frame member by filling the through-holes of the bottom wall with an adhesive.

12. The method according to claim 1, wherein the step of preparing the nozzle sheets comprises preparing the nozzle sheets each of which has the plurality of nozzles arranged in at least one array in the reference direction, and wherein the step of fixing the first and second cavity units to the frame member comprises fixing the first and second cavity units to the frame member such that the respective arrays of nozzles of the first and second cavity units are parallel to each other and distant from each other by a predetermined distance.

13. The method according to claim 1, wherein the step of preparing the nozzle sheets comprises preparing the nozzle sheets each of which is elongate, has the two first positioning holes in lengthwise opposite end portions thereof, respectively, and has the two second positioning holes in the lengthwise opposite end portions thereof, respectively, wherein one of the two first positioning holes is a circular hole and the other first positioning hole is an elongate hole, and wherein one of the two second positioning holes is a circular hole and the other second positioning hole is an elongate hole.

14. The method according to claim 13, wherein the step of preparing the channel units comprises preparing the channel units each of which has two first relief holes to communicate, when said each channel unit and said corresponding one of the nozzle sheets are fixed to each other, with the two first positioning holes of said corresponding nozzle sheet, respectively, and allow the two positioning pins of the first jig to enter the two first relieve holes via the two first positioning holes, respectively, and additionally has two second relief holes to communicate, in a state in which said each channel unit and said corresponding nozzle sheet are fixed to each other, with the two second positioning holes of said corresponding nozzle sheet, respectively, and allow a corresponding one pair of second positioning pins out of the first and second pairs of second positioning pins of the second jig to enter the two second relief holes via the two second positioning holes respectively, wherein one of the two first relief holes is a circular hole and the other first relief hole is an elongate hole, and wherein one of the two second relief holes is a circular hole and the other second relief hole is an elongate hole.

15. The method according to claim 14, wherein a diameter of the circular first relief hole is greater than a diameter of the circular first positioning hole, and a diameter of the circular second relief hole is greater than a diameter of the circular second positioning hole, and wherein a width of the elongate first relief hole is greater than a width of the elongate first positioning hole, and a width of the elongate second relief hole is greater than a width of the elongate second positioning hole.

* * * * *